US005659274A

United States Patent [19]

Takahashi et al.

[11] Patent Number: 5,659,274

[45] Date of Patent: Aug. 19, 1997

[54] STRIP DUAL MODE FILTER IN WHICH A RESONANCE WIDTH OF A MICROWAVE IS ADJUSTED

[75] Inventors: Kazuaki Takahashi; Munenori Fujimura; Hiroyuki Yabuki, all of Kawasaki; Mitsuo Makimoto, Yokohama, all of Japan

[73] Assignee: Matsushita Electric Industrial Co., Ltd., Osaka, Japan

[21] Appl. No.: 534,470

[22] Filed: Sep. 27, 1995

Related U.S. Application Data

[62] Division of Ser. No. 291,811, Aug. 17, 1994, Pat. No. 5,479,142, which is a division of Ser. No. 71,112, Jun. 3, 1993, Pat. No. 5,400,002.

[30] Foreign Application Priority Data

| | | | |
|---|---|---|---|
| Jun. 12, 1992 | [JP] | Japan | 4-153243 |
| Sep. 14, 1992 | [JP] | Japan | 4-244373 |
| Sep. 14, 1992 | [JP] | Japan | 4-244398 |
| Sep. 28, 1992 | [JP] | Japan | 4-257799 |
| Dec. 7, 1992 | [JP] | Japan | 4-326588 |

[51] Int. Cl.[6] ..... H01P 1/203; H01P 7/08

[52] U.S. Cl. ..... 333/204; 333/219

[58] Field of Search ..... 333/202, 204, 333/205, 219, 246, 235

[56] References Cited

U.S. PATENT DOCUMENTS

| | | | |
|---|---|---|---|
| 4,112,395 | 9/1978 | Seward | 333/17.3 |
| 4,327,342 | 4/1982 | De Ronde | 333/204 |
| 4,488,131 | 12/1984 | Griffin et al. | 333/205 |
| 5,172,084 | 12/1992 | Fiediuszko | 333/219 X |
| 5,313,662 | 5/1994 | Ooi et al. | 333/204 X |
| 5,369,383 | 11/1994 | Takahashi et al. | 333/204 |

FOREIGN PATENT DOCUMENTS

| | | |
|---|---|---|
| 0532330 | 3/1993 | European Pat. Off. . |
| 2248621 | 5/1975 | France . |
| 61-251203 | 11/1986 | Japan . |
| 62-298202 | 12/1987 | Japan . |
| 0001302 | 1/1989 | Japan . |

OTHER PUBLICATIONS

1990 IEEE MTT-S International Microwave Symposium--Digest, vol. 1; May 8-10, 1990 Dallas, US; IEEE, New York, US, 1990; X.H. Jiao et al.: "Microwave frequency agile active filters for MIC and MMIC applications", pp. 503-506.

IRE Transactions on Microwave Theory and Techniques, vol. 9, No. 7, Jul. 1961, New York, US; pp. 359-360; J.A. Kaiser "Ring network filter".

"Miniature Dual Mode Microstrip Filters" by J.A. Curtis et al.; 1991 IEEE MTT-S Digest pp. 443-446.

*Primary Examiner*—Benny Lee
*Assistant Examiner*—Justin P. Bettendorf
*Attorney, Agent, or Firm*—Lowe, Price, LeBlanc & Becker

[57] ABSTRACT

A strip dual mode filter includes a strip line ring resonator having a uniform line impedance and an electric length equivalent to a wavelength of a microwave, an input terminal coupled to a point A of the ring resonator, a feed-back circuit connected to points C and D and arranged in a central hollow space of the ring resonator and an output terminal coupled to a point B of the ring resonator. The points A to D are spaced by a quarter-wave length of the microwave in that order. The microwave input to the point A is resonated in the ring resonator in a first mode and is input to the feed-back circuit from the point C. Therefore, a phase of the microwave shifts by a multiple of a half-wave length of the microwave, and the microwave is output to the point D. Thereafter, the microwave is resonated in the ring resonator in a second mode orthogonal to the first mode and is output from the point B to the output terminal. Therefore, the microwave can be resonated and filtered in two orthogonal modes in the strip dual mode filter.

6 Claims, 15 Drawing Sheets

| ATTENUATION OF MICROWAVES | HARMONIC COMPONENTS OF MICROWAVES | | | |
|---|---|---|---|---|
| | 2Fo | 3Fo | 4Fo | 5Fo |
| PRESENT EMBODIMENT | 23dB | 43dB | 41dB | 44dB |
| CONVENTIONAL FILTER | 7dB | 4dB | 2dB | 3dB |

STRIP DUAL MODE FILTER IN WHICH A RESONANCE WIDTH OF A MICROWAVE IS ADJUSTED

This application is a division of application Ser. No. 08/291,811 filed Aug. 17, 1994, now U.S. Pat. No. 5,479,142 which is a Divisional application of U.S. Ser. No. 08/071,112 filed Jun. 3, 1993 now U.S. Pat. No. 5,400,002.

BACKGROUND OF THE INVENTION

1. Field of the Invention

The present invention relates generally to a strip dual mode filter utilized to filter microwaves in frequency bands ranging from an ultra high frequency (UHF) band to a super high frequency (SHF) band, and more particularly to a strip dual mode filter in which a resonance width of the microwaves is suitably adjusted. Also, the present invention relates to a dual mode multistage filter in which the strip dual mode filters are arranged in series.

2. Description of the Related Art

A half-wave length open end type of strip ring resonating filter has been generally utilized to filter microwaves ranging from the UHF band to the SHF band, Also, a one-wavelength type of strip ring resonating filter has been recently known. In the one-wavelength type of strip ring resonating filter, no open end to reflect the microwaves is required because a line length of the strip ring resonating filter is equivalent to one wavelength of the microwaves. Therefore, the microwaves are efficiently filtered because energy of the microwaves is not lost in the open end.

However, there are many drawbacks in the one-wavelength type of strip ring resonating filter. That is, it is difficult to manufacture a small-sized strip ring resonating filter because a central portion surrounded by the strip ring resonating filter is a dead space.

Therefore, a dual mode filter in which microwaves in two orthogonal modes are resonated and filtered has been recently proposed. The dual mode filter has not yet been put to practical use.

2-1. Previously Proposed Art

A first conventional strip dual mode filter is described.

FIG. 1 is a plan view of a strip dual mode filter functioning as a two-stage filter.

As shown in FIG. 1, a strip dual mode filter 11 conventionally utilized is provided with an input strip line 12 in which microwaves are transmitted, a one-wavelength type of strip ring resonator 13 electrically coupled to the input strip line in capacitive coupling, and an output strip line 14 electrically coupled to the strip ring resonator 13 in capacitive coupling.

The input strip line 12 is coupled to the strip ring resonator 13 through a gap capacitor 15, and the output strip line 14 is coupled to the strip ring resonator 13 through a gap capacitor 16. Also, the output strip line 14 is spaced 90 degrees (or a quarter of a wavelength of the microwaves) in electric length apart from the input strip line 12.

The strip ring resonator 13 has an open end stub 17 in which the microwaves are reflected. The open end stub 17 is spaced 135 degrees in the electric length apart from the input and output strip lines 12, 14.

In the above configuration, the action of the strip dual mode filter 11 is qualitatively described in a concept of travelling wave.

When a travelling wave is transmitted in the input strip line 12, electric field is induced in the gap capacitor 15.

Therefore, the input strip line 12 is coupled to the strip ring resonator 13 in the capacitive coupling, so that a strong intensity of electric field is induced to a coupling point P1 of the strip ring resonator 13 adjacent to the input strip line 12. The electric field strongly induced is diffused into the strip ring resonator 13 as travelling waves. That is, one of the travelling waves is transmitted in a clockwise direction and another travelling wave is transmitted in a counterclockwise direction.

An action of the travelling wave transmitted in the counterclockwise direction is initially described.

When the travelling wave reaches a coupling point P2 of the strip ring resonator 13 adjacent to the output line 14, the phase of the travelling wave is shifted 90 degrees. Therefore, the intensity of the electric field at the coupling point P2 is minimized. Accordingly, the output strip line 14 is not coupled to the strip ring resonator 13 in the capacitive coupling.

Thereafter, when the travelling wave reaches the open end stub 17, the phase of the travelling wave is further shifted 135 degrees as compared with the phase of the travelling wave reaching the coupling point P2. Because the open end stub 17 is equivalent to a discontinuous portion of the strip ring resonator 13, a part of the travelling wave is reflected at the open end stub 17 to produce a reflected wave, and a remaining part of the travelling wave is not reflected at the open end stub 17 to produce a non-reflected wave.

The non-reflected wave is transmitted to the coupling point P1. In this case, because the phase of the non-reflected wave transmitted to the coupling point P1 is totally shifted 360 degrees as compared with that of the travelling wave transmitted from the input strip line 12 to the coupling point P1, the intensity of the electric field at the coupling point P1 is maximized. Therefore, the input strip line 12 is coupled to the strip ring resonator 13 so that a part of the non-reflected wave is returned to the input strip line 12. A remaining part of the non-reflected wave is again circulated in the counterclockwise direction so that the microwaves transferred to the strip ring resonator 13 are resonated.

In contrast, the reflected wave is returned to the coupling point P2. In this case, the phase of the reflected wave at the coupling point P2 is further shifted 135 degrees as compared with that of the reflected wave at the open end stub 17. This is, the phase of the reflected wave at the coupling point P2 is totally shifted 360 degrees as compared with that of the travelling wave transferred from the input strip line 12 to the coupling point P1. Therefore, the intensity of the electric field at the coupling point P2 is maximized, so that the output strip line 12 is coupled to the strip ring resonator 13. As a result, a part of the reflected wave is transferred to the input strip line 12. A remaining part of the reflected wave is again circulated in the clockwise direction so that the microwaves transferred to the strip ring resonator 13 are resonated.

Next, the travelling wave transmitted in the clockwise direction is described.

A part of the travelling wave is reflected at the open end stub 17 to produce a reflected wave when the phase of the travelling wave is shifted 135 degrees. A non-reflected wave formed of a remaining part of the travelling wave reaches the coupling point P2. The phase of the non-reflected wave is totally shifted 270 degrees so that am intensity of the electric field induced by the non-reflected wave is minimized. Therefore, the non-reflected wave is not transferred to the output strip line 14. That is, a part of the non-reflected wave is transferred to the input strip line 12 in the same manner, and a remaining part of the non-reflected wave is again circulated in the clockwise direction so that the microwaves transferred to the strip ring resonator 13 are resonated.

In contrast, the reflected wave is return to the coupling point P1. In this case, because the phase of the reflected wave at the coupling point P1 is totally shifted 270 degrees, an intensity of the electric field induced by the reflected wave is minimized so that the reflected wave is not transferred to the input strip line 12. Thereafter, the reflected wave reaches the coupling point P2. In this case, because the phase of the reflected wave at the coupling point P2 is totally shifted 360 degrees, an intensity of the electric field induced by the reflected wave is maximized. Therefore, a part of the reflected wave is transferred to the output strip line 14, and a remaining part of the reflected wave is again circulated in the counterclockwise direction so that the microwaves transferred to the strip ring resonator 13 are resonated.

Accordingly, because the microwaves can be resonated in the strip ring resonator 13 on condition that a wavelength of the microwaves equals the strip line length of the strip ring resonator 13, the strip dual mode filter 11 functions as a resonator and a filter.

Also, the microwaves transferred from the input strip line 12 are initially transmitted in the strip ring resonator 13 as the non-reflected waves, and the microwaves are again transmitted in the strip ring resonator 13 as the reflected waves shifted 90 degrees as compared with the non-reflected waves. In other words, two orthogonal modes formed of the non-reflected wave and the reflected wave independently coexist in the strip ring resonator 13. Therefore, the strip dual mode filter 11 functions as a dual mode filter. That is, the function of the strip dual mode filter 11 is equivalent to a pair of a single mode filters arranged in series.

In addition, a ratio in the intensity of the reflected wave to the non-reflected wave is changed in proportional to the length of the open end stub 17 projected in a radial direction of the strip ring resonator 13. Therefore, the intensity of the reflected microwaves transferred to the output strip line 14 can be adjusted by trimming the open end stub 17.

The strip dual mode filter 11 is proposed by J. A. Curtis "International Microwave Symposium Digest", IEEE, page 443–448(N-1), 1991.

2-2. Another Previously Processed Art

Next, a conventional multistage filter is described.

FIG. 2A is a plan view of a conventional multistage filter in which two strip dual mode filters 11 are arranged in series.

As shown in FIG. 2A, a conventional multistage filter 21 consists of the strip dual mode filter 11*a* in a first stage, the strip dual mode filter 11*b* in a second stage, an inter-stage strip line 22 of which one end is coupled to a coupling point P8 spaced 90 degrees apart from the coupling point P1 of the strip dual mode filter 11*a* and another end is coupled to a coupling point P4 spaced 90 degrees apart from the coupling point P2 of the strip dual mode filter 11*b*, and a secondary inter-stage strip line 23 of which one end is coupled to a coupling point P5 spaced 180 degrees apart from the coupling point P1 of the strip dual mode filter 11*a* and another end is coupled to a coupling point P8 spaced 180 degrees apart from the coupling point P2 of the strip dual mode filter 11*b*.

In the above configuration, when microwaves are transferred to the coupling point P1 of the strip dual mode filter 11*a*, a greater part of the microwaves are reflected at the open end stub 17 of the strip dual mode filter 11*a* to produce reflected microwaves. Also, a remaining part of the microwaves are not reflected to produce non-reflected microwaves. Thereafter, the intensity of the electric field induced by the reflected microwaves is maximized at the coupling point P3 of the strip dual mode filter 11*a*. Therefore, the reflected microwaves are transferred to the strip dual mode filter 11*b* through the inter-stage strip line 22. Thereafter, the reflected microwaves are again reflected at the open end stub 17 of the strip dual mode filter 11*b* so that the intensity of the electric field at the coupling point P2 is maximized. Therefore, the reflected microwaves are transferred to the output strip line 14.

Also, the non-reflected microwaves are circulated in the strip dual mode filter 11*a*, and the intensity of the electric field induced by the non-reflected microwaves is maximized at the coupling point P5. Therefore, the non-reflected microwaves are transferred to the coupling point P6 of the strip dual mode filter 11*b* through the secondary inter-stage strip line 23. Thereafter, the non-reflected microwaves are circulated in the strip dual mode filter 11*b*, and the intensity of the electric field induced by the non-reflected microwaves is maximized at the coupling point P2. Therefore, the non-reflected microwaves are also transferred to the output strip line 14.

In this case, the strip dual mode filters 11*a*, 11*b* respectively function as a resonator and filter in dual modes for the reflected microwaves. Therefore, a resonance width of the reflected microwaves obtained in the output strip line 14 is narrow. In contrast, the strip dual mode filters 11*a*, 11*b* respectively function as a resonator and filter in a single mode for the non-reflected microwaves. Therefore, a resonance width of the non-reflected microwaves obtained in the output strip line 14 is wide.

Also, the phase of the reflected microwaves shifts by 90 degrees in the strip dual mode filter 11*a* as compared with that of the non-reflected microwaves, and the phase of the reflected microwaves additionally shifts by 90 degrees in the strip dual mode filter 11*b* as compared with that of the non-reflected microwaves. Therefore, the phase of the reflected microwaves totally shifts by 180 degrees as compared with that of the non-reflected microwaves.

In addition, the intensity of the reflected microwaves is greatly larger than that of the non-reflected microwaves.

Therefore, as shown in FIG. 2B, frequency characteristics of the reflected microwaves and the non-reflected microwaves are obtained. As a result, the reflected microwaves and the non-reflected are interfered with each other in the output strip line 14 to produce interfered microwaves. In this case, as shown in FIG. 2C, two notches (or two poles) are generated at both sides of a resonance frequency $\omega_o$ (or a central frequency) of the interfered microwaves.

As is well known, when a fundamental component of the microwaves is resonated and filtered in the multistage filter 21, a resonance width $2\Delta\omega$ of the fundamental component is greatly narrow. However, when an N-degree harmonic component of the microwaves is resonated and filtered in the multistage filter 21, a resonance width $2N\Delta\omega$ of the N-degree harmonic component becomes wide in proportion as the number N is increased.

Accordingly, the fundamental component of the microwaves and a few low-degree harmonic components of the microwaves can be steeply resonated and filtered in the multistage filter 21. Therefore, the multistage filter 21 can function as an elliptic filter in which the notches are deeply generated at both sides of the resonance frequency.

2-3. Problems to be Solved by the Invention

However, there are many drawbacks in the strip dual mode filter 11. That is, because a resonance width (or a full width at half maximum) is adjusted only by trimming the length of the open end stub 17, the resonance width cannot be enlarged. In other words; in cases where the width of the open end stub 17 in the circumferential direction is widened to enlarge the resonance width, the phase of the reflected wave reaching the output strip line 14 is undesirably shifted. As a result, the intensity of the microwaves transmitting through the output strip line 14 is lowered at a central wavelength (or a resonance frequency) of the microwaves resonated.

In addition, in cases where a plurality of strip dual mode filter 11 are arranged in series to manufacture a multistage filter, the resonance width of the multistage filter is furthermore narrowed. Accordingly, the multistage filter is not useful for practical use.

Also, there are many drawbacks in the multistage filter 21. That is, because the reflected microwaves are produced by only the open end stubs 17, the characteristic impedance of the multistage filter 21 cannot be suitably adjusted. Also, a resonance width in the filter 21 is narrowed so that the multistage filter 21 is not useful for practical use.

SUMMARY OF THE INVENTION

An object of the present invention is to provide, with due consideration to the drawbacks of such a conventional strip dual mode filter, a strip dual mode filter in which the resonance width is suitably adjusted and active elements are easily attached.

The object is achieved by the provision of a strip dual mode filter in which a microwave is resonated and filtered, comprising:

a closed loop-shaped strip line for resonating and filtering the microwave according to a characteristic impedance of the closed loop-shaped strip line, the closed loop-shaped strip line having an electric length equivalent to a wavelength of the microwave and having a uniform line impedance;

input coupling means for transferring the microwave to a first coupling point of the closed loop-shaped strip line in electromagnetic coupling;

a secondary microwave transmitting line for transmitting the microwave resonated and filtered in the closed loop-shaped strip line to change the characteristic impedance of the closed loop-shaped strip line, the secondary microwave transmitting line being coupled to second and third coupling points of the closed loop-shaped strip line in electromagnetic coupling, the second coupling point being spaced a half-wave length of the microwave apart from the first coupling point, and the third coupling point being spaced a quarter-wave length of the microwave apart from the first coupling point; and output coupling means for outputting the microwave which is resonated and filtered in the close loop-shaped strip line according to the characteristic impedance of the closed-loop shaped strip line changed by the secondary microwave transmitting line, the microwave being output from a fourth coupling point spaced a half-wave length of the microwave apart from the third coupling point in electromagnetic coupling, wherein the secondary microwave transmitting line comprises a feedback circuit in which a phase of the microwave transferred from the second coupling point of the closed loop-shaped strip line shifts by a multiple of a half-wave length of the microwave to produce a feed-back microwave which is transferred to the third coupling point of the closed loop-shaped strip line, the input coupling means comprises a microwave receiver and an input coupling inductor for coupling the microwave receiver to the closed loop-shaped strip line in inductive coupling, and the output coupling means comprises a microwave transfer and a n output coupling inductor for coupling the microwave transfer to the closed loop-shaped strip line in inductive coupling.

In the above configuration, when the microwave receiver receives the microwave, magnetic field is induced in the input coupling inductor so that the magnetic field is also induced in the first coupling point of the closed loop-shaped strip line. That is, the microwave is transferred from the input terminal to the strip line. Thereafter, the microwave is circulated in the strip line, and the intensity of the magnetic field induced by the microwave is maximized at the second coupling point because the second coupling point is spaced the half-wave length of the microwave apart from the first coupling point. Therefore, the feed-back circuit is coupled to the closed loop-shaped strip line at the second coupling point. Thereafter, the microwave is transferred from the loop-shaped strip line to the feed-back circuit through the second coupling point.

In the feed-back circuit, the phase of the microwave shifts by a multiple of the half-wave length of the microwave to produce a feed-back microwave. Therefore, the intensity of the magnetic field at the third coupling point of the loop-shaped strip line is maximized by the feed-back microwave. Thereafter, the feed-back microwave is circulated in the closed loop-shaped strip line to be resonated and filtered. In this case, the intensity of the magnetic field at the fourth coupling point of the closed loop-shaped strip line is maximized by the feed-back microwave because the fourth coupling point is spaced a half-wave length of the microwave apart from the third coupling point. Therefore, the magnetic field is also induced in the output coupling inductor so that the microwave transfer is coupled to the closed loop-shaped strip line. Thereafter, the feed-back microwave is output from the fourth coupling point to the microwave transfer by the action of the output coupling inductor.

Accordingly, because the characteristic impedance of the closed loop-shaped strip line is changed by the feed-back circuit, the microwave and the feed-back microwave of which the phase is orthogonal to that of the microwave independently coexist in the closed loop-shaped strip line. Therefore, the feed-back microwave can be output from the fourth coupling point even though the fourth coupling point is spaced a quarter-wave length of the microwave apart from the first coupling point.

The object is also achieved by the provision of a strip dual mode filter in which a microwave is resonated and filtered, comprising:

a closed loop-shaped strip line having a pair of straight strip lines coupled to each other in electromagnetic coupling for resonating and filtering the microwave according to a characteristic impedance of the closed loop-shaped strip line while changing the characteristic impedance in the pair of straight strip lines to shift a phase of the microwave by a quarter-wave length of the microwave, the closed loop-shaped strip line having an electric length equivalent to a wavelength of the microwave and having a uniform line impedance;

input coupling means for transferring the microwave to a first coupling point of the closed loop-shaped strip line in electromagnetic coupling; and output coupling means for outputting the microwave resonated and filtered in the closed loop-shaped strip line according to the characteristic impedance of the closed loop-shaped strip line, the microwave being output from a second coupling point spaced a quarter-wave length of the microwave apart from the first coupling point.

In the above configuration, the microwave input from the input coupling means is resonated in the closed loop-shaped strip line in a first resonance mode and shifts by a quarter-wave length of the microwave because the pair of straight strip lines coupled to each other in electromagnetic coupling. Therefore, the microwave is resonated in the closed loop-shaped strip line in a second resonance mode orthogonal to the first resonance mode and is output from the second coupling point to the output coupling means.

Accordingly, because two orthogonal resonance modes coexist in the strip dual mode filter, the microwave is resonated twice, and the strip dual mode filter functions as a dual mode filter.

BRIEF DESCRIPTION OF THE DRAWINGS

The objects, features and advantages of the present invention will be apparent from the following description taken in conjunction with the accompanying drawings, in which.

DETAIL DESCRIPTION OF THE PREFERRED EMBODIMENTS

Preferred embodiments of a strip dual mode filter according to the present invention are described with reference to drawings.

A first embodiment of a first concept according to the present invention is initially described.

Figure 3:
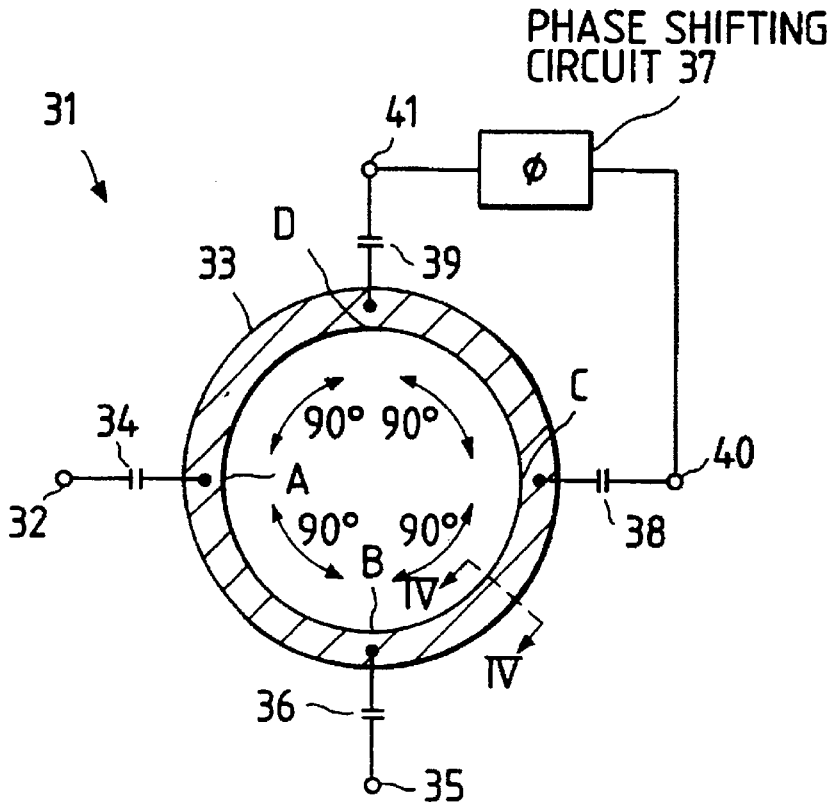
FIG. 3 is a plan view of a strip dual mode filter according to a first concept.
Figure 4A:
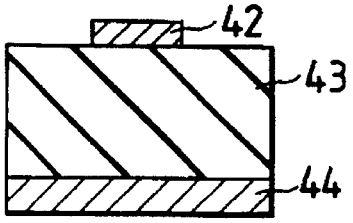
FIG. 4A is a sectional view taken generally along the line IV—IV of FIG. 3.
Figure 4B:
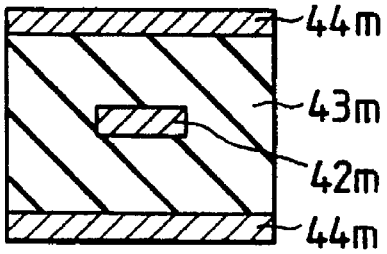
FIG. 4B is another sectional view taken generally along the line IV—IV of FIG. 3 according to another modification of the first concept.

FIG. 3 is a plan view of a strip dual mode filter according to a first concept. FIG. 4A is a sectional view taken generally along the line IV—IV of FIG. 3. FIG. 4B is another sectional view taken generally alone the line IV—IV of FIG. 3 according to another modification of the first concept.

As shown in FIG. 3, a strip dual mode filter 31 according to a first concept comprises an input terminal 32 excited by microwaves, a strip line ring resonator 33 in which the microwaves are resonated, an input coupling capacitor 34 connecting the input terminal 32 and a coupling point A of the ring resonator 33 to couple the input terminal 32 excited by the microwaves to the ring resonator 33 in capacitive coupling, an output terminal 35 which is excited by the microwaves resonated in the ring resonator 33, an output coupling capacitor 36 connecting the output terminal 35 and a coupling point B in the ring resonator 33 to couple the output terminal 35 to the ring resonator 33 in capacitive coupling, a phase-shifting circuit 37 coupled to a coupling point C and a coupling point D of the ring resonator 33, a first coupling capacitor 38 for coupling a connecting terminal 40 of the phase-shifting circuit 37 to the coupling point C in capacitive coupling, and a second coupling capacitor 39 for coupling another connecting terminal 41 of the phase-shifting circuit 37 to the coupling point D in capacitive coupling.

The ring resonator 33 has a uniform line impedance and an electric length which is equivalent to a resonance wavelength $\lambda_o$. In this specification, the electric length of a closed loop-shaped strip line such as the ring resonator 33 is expressed in an angular unit. For example, the electric length of the ring resonator 33 equivalent to the resonance wavelength $\lambda_o$ is called 360 degrees.

The input and output coupling capacitors 34, 36 and first and second coupling capacitors 38, 39 are respectively formed of a plate capacitor.

The coupling point B is spaced 90 degrees in the electric length (or a quarter-wave length of the microwaves) apart from the coupling point A. The coupling point C is spaced 180 degrees in the electric length (or a half-wave length of the microwaves) apart from the coupling point A. The coupling point D is spaced 180 degrees in the electric length apart from the coupling point B.

The phase-shifting circuit 37 is made of one or more passive or active elements such as a capacitor, an inductor, a strip line, an amplifier, a combination unit of those elements, or the like. A phase of the microwaves transferred to the phase-shifting circuit 37 shifts by a multiple of a half-wave length of the microwaves to produce phase-shift microwaves. Therefore, the phase-shifting circuit 37 functions as a secondary microwave transmitting line in which the microwaves are transmitted from the coupling point C to the coupling point D.

As shown in FIG. 4A, the ring resonator 33 comprises a strip conductive plate 42, a dielectric substrate 43 mounting the strip conductive plate 42, and a conductive substrate 44 mounting the dielectric substrate 43. That is, the ring resonator 33 is formed of a microstrip line. The wavelength of the microwaves depends on a relative dielectric constant $\epsilon_r$ of the dielectric substrate 43 so that the electric length of the ring resonator 33 depends on the relative dielectric constant $\epsilon_r$.

The first concept is not limited to the microstrip line. That is, it is allowed that the ring resonator 33 be formed of a balanced strip line shown in FIG. 4B. As shown in FIG. 4B, the ring resonator 33 comprises a strip conductive plate **42*m*, a dielectric substrate 43*m* surrounding the strip conductive plate 42*m*, and a pair of conductive substrates 44*m* sandwiching the dielectric substrate 43*m***.

In the above configuration, when the input terminal 32 is excited by microwaves having various wavelengths around the resonance wavelength $\lambda_o$, electric field is induced around the input coupling capacitor 34 so that the intensity of the electric field at the coupling point A of the ring resonator 33 is increased to a maximum value. Therefore, the input terminal 32 is coupled to the ring resonator 33 in the capacitive coupling, and the microwaves are transferred from the input terminal 32 to the coupling point A of the ring resonator 33. Thereafter, the microwaves are circulated in the ring resonator 33 in clockwise and counterclockwise directions. In this case, the microwaves having the resonance wavelength $\lambda_o$ are selectively resonated according to a first resonance mode.

The intensity of the electric field induced by the microwaves resonated is minimized at the coupling point B spaced 90 degrees in the electric length apart from the coupling point A because the intensity of the electric field at the coupling point A is increased to the maximum value. Therefore, the microwaves are not transferred to the output terminal 35. Also, the intensity of the electric field is minimized at the coupling point D spaced 90 degrees in the electric length apart from the coupling point A so that the microwaves are not transferred from the coupling point D to the phase-shifting circuit 37. In contrast, because the coupling point C is spaced 180 degrees in the electric length apart from the coupling point A, the intensity of the electric field at the coupling point C is maximized, and the connecting terminal 40 is excited by the microwaves circulated in the ring resonator 33. Therefore, the microwaves are transferred from the coupling point C to the phase-shifting circuit 37 through the first coupling capacitor 38.

In the phase-shifting circuit 37, the phase of the microwaves shifts to produce the phase-shift microwaves. For example, the phase of the microwaves shifts by a half-wave length thereof. Thereafter, the connecting terminal 41 is excited by the phase-shift microwaves, and the phase-shift microwaves are transferred to the coupling point D through the second coupling capacitor 39. Therefore, the intensity of the electric field at the coupling point D is increased to the maximum value. Thereafter, the phase-shift microwaves are circulated in the ring resonator 33 in the clockwise and counterclockwise directions so that the phase-shift microwaves are resonated according to a second resonance mode. In this case, a resonance width (or a full width at half maximum) of the phase-shift microwaves is determined according to a characteristic impedance of the ring resonator 33. The characteristic impedance of the ring resonator 33 depends on the uniform line impedance of the ring resonator 33 and a characteristic impedance of the phase-shifting circuit 37. In other words, the characteristic impedance of the ring resonator 33 is changed by the phase-shifting circuit 37 functioning as a secondary microwave transmitting line.

Thereafter, because the coupling point B is spaced 180 degrees in the electric length apart from the coupling point D, the intensity of the electric field is increased at the coupling point B. Therefore, electric field is induced around the output coupling capacitor 36, so that the output terminal 35 is coupled to the coupling point B in the capacitive coupling. Thereafter, the phase-shift microwaves are transferred from the coupling point B to the output terminal 35. In contrast, because the coupling points A, C are respectively spaced 90 degrees in the electric length apart from the coupling point D, the intensity of the electric field induced by the phase-shift microwaves is minimized at the coupling points A, C. Therefore, the phase-shift microwaves are transferred to neither the input terminal 32 nor the connecting terminal 40.

Accordingly, the microwaves having the resonance wavelength $\lambda_o$ are selectively resonated in the ring resonator 33 and are transferred to the output terminal 35. Therefore, the strip dual mode filter 31 functions as a resonator and filter.

The microwaves transferred from the input terminal 32 are initially resonated in the ring resonator 33 according to the first resonance mode, and the phase-shift microwaves are again resonated in the ring resonator 33 according to the second resonance mode. Also, the phase of the phase-shift microwaves shifts by 90 degrees as compared with the microwaves. Therefore, two orthogonal modes formed of the first resonance mode and the second resonance mode independently coexist in the ring resonator 33. Therefore, the strip dual mode filter 31 functions as a dual mode filter.

Figure 1:
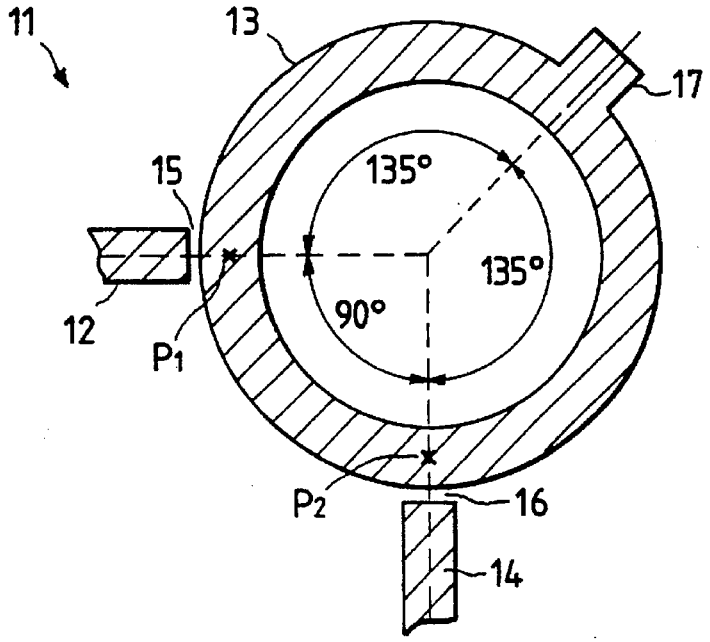
FIG. 1 PRIOR ART
FIG. 1 is a plan view of a conventional strip dual mode filter functioning as a two-stage filter.

Also, because the resonance width of the phase-shift microwaves depends on the characteristic impedance of the phase-shifting circuit 37, the resonance width of the phase-shift microwaves can be suitably widened by changing the characteristic impedance of the phase-shifting circuit 37. The reason that the resonance width are widened is as follows. In the conventional strip dual mode filter 11 shown in FIG. 1, the reflected microwaves are produced and resonated. In this case, the control of the amount of the reflected microwaves is difficult so that it is difficult to widen the resonance width of the reflected microwaves. In contrast, the amount of the phase-shift microwaves produced in the phase-shifting circuit 37 functioning as a secondary microwave transmitting line can be easily controlled by adjusting coupling degrees at the coupling points C, D and the degree of phase shift at the phase-shifting circuit 37. Therefore, the resonance width of the phase-shift microwaves can be easily adjusted at a wide wavelength range of the phase-shift microwaves in the present invention.

Also, active elements can be provided in the phase-shifting circuit 37 to manufacture a tuning filter having an amplifying function or an electric power amplifier.

Next, a first embodiment of the first concept is described to embody the phase-shifting circuit 37.

Figure 5:
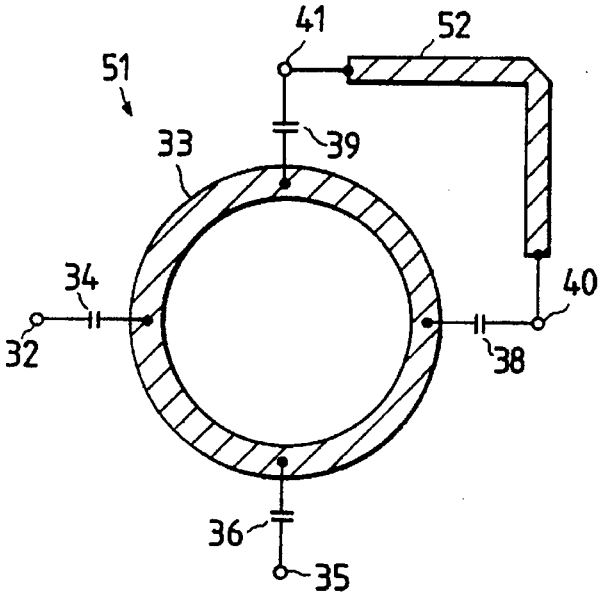
FIG. 5 is a plan view of a strip dual mode filter according to a first embodiment of the first concept shown in FIGS. 3, 4A.

FIG. 5 is a plan view of a strip dual mode filter according to a first embodiment of the first concept shown in FIGS. 3, 4A.

As shown in FIG. 5, a strip dual mode filter 51 comprises the input terminal 32, the strip line ring resonator 33, the input coupling capacitor 34, the output terminal 35, the output coupling capacitor 36, the first coupling capacitor the second coupling capacitor 39, and a strip line 52 connected to the connecting terminals 40, 41.

In the above configuration, the strip line 52 is arranged in the strip dual mode filter 51 as the phase-shifting circuit 37. Therefore, the phase of the microwaves transferred to the strip line 52 shifts in proportion to a length of the strip line 52 while depending on a width of the strip line 52. For example, in cases where the width of the strip line 52 is widened, the strip line 52 dominantly functions as a capacitor, and a capacity of the capacitor is varied in proportion to the length of the strip line 52. Also, in cases where the width of the strip line 52 is narrowed, the strip line 52 dominantly functions as an inductor, and an inductance of the inductor is varied in proportion to the length of the strip line 52.

Accordingly, the strip dual mode filter 51 functions as a resonator and filter in dual mode in the same manner as the strip dual mode filter 31.

Also, the resonance width can be suitably adjusted by changing the length and width of the strip line 52.

In the first embodiment, the strip line 52 is positioned at the outside of the strip line ring resonator 33. However, it is preferred that the strip line 52 be positioned at a central hollow area of the strip line ring resonator 33 to minimize the strip dual mode filter 51.

Next, a second embodiment of the first concept is described to embody the phase-shifting circuit 37 shown in FIG. 3.

Figure 6:
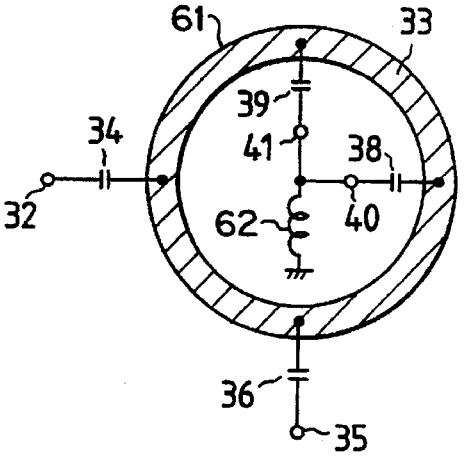
FIG. 6 is a plan view of a strip dual mode filter according to a second embodiment of the first concept shown in FIGS. 3, 4A.

FIG. 6 is a plan view of a strip dual mode filter according to a second embodiment of the first concept shown in FIGS. 3, 4A.

As shown in FIG. 6, a strip dual mode filter 61 comprises the input terminal 32, the strip line ring resonator 33, the input coupling capacitor 34, the output terminal 35, the output coupling capacitor 36, the first coupling capacitor the second coupling capacitor 39, and a parallel-connected inductor 62 of which one end is connected to the connecting terminals 40, 41 and another end is grounded.

A T-type high-pass filter is generally provided with a pair of serially-connected capacitors and a parallel-connected inductor. In the second embodiment, the first coupling capacitor 38 and the second coupling capacitor 39 are substituted for the serially-connected capacitors. Therefore, a combination unit of the first and second coupling capacitors 38, 39 and the parallel-connected inductor 62 functions as a high-pass filter.

The parallel-connected inductor 62 is positioned at a central hollow space of the strip line ring resonator 33.

In the above configuration, microwaves having comparatively high frequency are transferred from the coupling point C to the coupling point D through the first coupling capacitor 38 and the second coupling capacitor 39. In contrast, microwaves having comparatively low frequency are not resonated because of the action of the parallel-connected inductor 62 in the strip dual mode filter 61.

Accordingly, because the microwaves having comparatively high frequency are selectively resonated and filtered, the strip dual mode filter 61 is useful to filter the microwaves having comparatively high frequency.

Also, because the first and second coupling capacitors 38, 39 and the parallel-connected inductor 62 are positioned at the central hollow space of the ring resonator 33, the strip dual mode filter 61 can be minimized.

Also, the resonance width can be suitably adjusted by changing an inductance of the parallel-connected inductor Next, a third embodiment of the first concept is described to embody the phase-shifting circuit 37 shown in FIG. 3.

Figure 7:
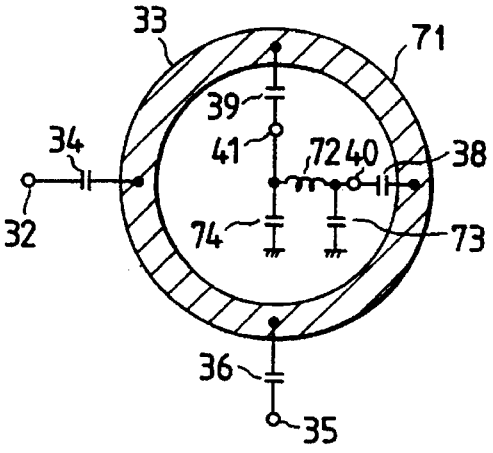
FIG. 7 is a plan view of a strip dual mode filter according to a third embodiment of the first concept shown in FIGS. 3, 4A.

FIG. 7 is a plan view of a strip dual mode filter according to a third embodiment of the first concept shown in FIGS. 3, 4A.

As shown in FIG. 7, a strip dual mode filter 71 comprises the input terminal 32, the strip line ring resonator 33, the input coupling capacitor 34, the output terminal 35, the output coupling capacitor 36, the first coupling capacitor 38, the second coupling capacitor 39, a serially-connected inductor 72 of which both ends are connected to the connecting terminals 40, 41, a first parallel-connected capacitor 73 of which one end is connected to the coupling capacitor 38 and another end is grounded, and a second parallel-connected capacitor 74 of which one end is connected to the coupling capacitor 39 and another end is grounded.

A π-type low-pass filter is formed of the serially-connected inductor 72 and the first and second parallel-connected capacitors 73, 74. Therefore, the phase-shifting circuit 37 functions as the π-type low-pass filter in the third embodiment. Also, the π-type low-pass filter is positioned at a central hollow space of the strip line ring resonator 33.

In the above configuration, microwaves having comparatively low frequency are transferred from the coupling point C to the coupling point D through the serially-connected inductor 72. In contrast, microwaves having comparatively high frequency are not resonated because of the first and second parallel-connected capacitors 73, 74.

Accordingly, because the microwaves having comparatively low frequency are selectively resonated and filtered, the strip dual mode filter 71 is useful to filter the microwaves having comparatively low frequency.

Also, because the serially-connected inductor 72 and the first and second parallel-connected capacitors 73, 74 are positioned at the central space of the ring resonator 33, the strip dual mode filter 71 can be minimized.

Also, the resonance width can be suitably adjusted by changing an inductance of the serially-connected inductor 72 and capacitances of the first and second parallel-connected capacitors 73, 74.

Next, a fourth embodiment of the first concept is described to embody the phase-shifting circuit 37 shown in FIG. 3.

Figure 8:
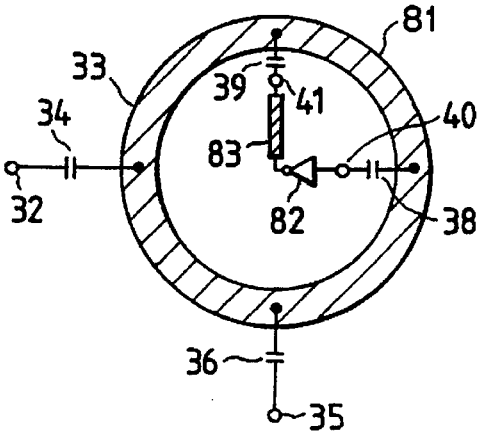
FIG. 8 is a plan view of a strip dual mode filter according to a fourth embodiment of the first concept shown in FIGS. 3, 4A.

FIG. 8 is a plan view of a strip dual mode filter according to a fourth embodiment of the first concept shown in FIGS. 3, 4A.

As shown in FIG. 8, a strip dual mode filter 81 comprises the input terminal 32, the strip line ring resonator 33, the input coupling capacitor 34, the output terminal 35, the output coupling capacitor 36, the first coupling capacitor 38, the second coupling capacitor 39, an amplifier 82 for amplifying the microwaves transferred from the coupling point C, and a phase correcting strip line 83 for correcting the phase of the microwaves amplified in the amplifier 82.

The amplifier 82 and the phase correcting strip line 83 function as the phase-shifting circuit 37 in which the amplifier 82 is provided as an active element.

In the above configuration, the microwaves are circulated in the ring resonator 33 according to a first resonance mode in which the electric field is maximized at the coupling points A, C. Thereafter, the microwaves are transferred from the coupling point C to the amplifier 82 so that the microwaves are amplified. Thereafter, the phase of the microwaves is corrected in the phase correcting strip line 83 to excite the connecting terminal 41 with the microwaves in which the intensity of the electric field is increased to a maximum value. Therefore, the intensity of the electric field is maximized at the coupling point D. Thereafter, the phase-shift microwaves in the strip line 83 are circulated in the ring resonator 33 according to a second resonance mode in which the electric field is maximized at the coupling points B,D. In this case, because a reverse direction transfer characteristic of the amplifier 82 is extremely small, the phase-shift microwaves are not transferred from the coupling point D to the coupling point C through the amplifier 82. Therefore, the microwaves according to the first resonance mode and the phase-shift microwaves according to the second resonance mode are not directly coupled to each other.

Thereafter, the phase-shift microwaves amplified in the amplifier 82 are output to the output terminal 35.

Accordingly, the strip dual mode filter 81 functions as a two-stage tuning amplifier because the filter 81 functions as both a two-stage filter and an amplifier.

Also, in cases where the strip dual mode filter 81 functions as a wide raged band-pass filter for the microwaves according to the first resonance mode and the filter 81 functions as a narrow ranged band-pass filter for the phase-shift microwaves according to the second resonance mode, a noise figure (NF) of the two-stage tuning amplifier can be improved. Accordingly, the strip dual mode filter 81 can be applied for a transceiver.

As the first concept is embodied in the first to fourth embodiments, the phase-shifting circuit 37 is suitably added to the ring resonator 33 as an external circuit, so that the relationship between the first resonance mode of the microwaves and the second resonance mode of the phase-shift microwaves can be arbitrary controlled.

In the first to fourth embodiments of the first concept, four types of electric circuits 52, 62, 72, 73, 74, 82, and 83 are shown as the phase-shifting circuit 37. However, it is preferred that the electric circuits be combined to make the phase-shifting circuit 37.

Next, a fifth embodiment of the first concept is described.

Figure 9:
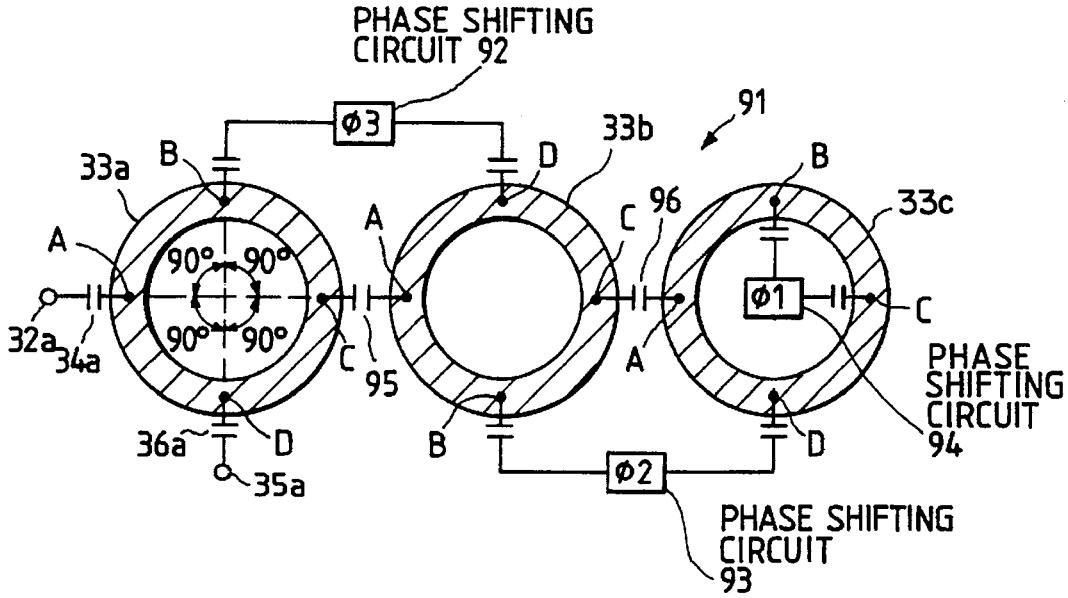
FIG. 9 is a plan view of a dual mode multistage filter according to a fifth embodiment of the first concept shown in FIGS. 3, 4A, the dual mode multistage filter consisting of a series of three strip dual mode filters shown in FIG. 3.

FIG. 9 is a plan view of a dual mode multistage filter in which three strip dual mode filters shown in FIGS. 3, 4A are arranged in series.

As shown in FIG. 9, a dual mode multistage filter 91 comprises the ring resonator 33*a* arranged in a first-stage, the input terminal 32*a* coupled to the ring resonator through the input coupling capacitor 34*a*, the output terminal 35*a* coupled to the ring resonator 33*a* through the output coupling capacitor 36*a*, the ring resonator 33*b* arranged in a second-stage, the ring resonator 33*c* arranged in a third-stage, a phase-shifting circuit 92 of which one end is coupled to the coupling point B of the first stage ring resonator 33*a* through a coupling capacitor and the other end is coupled to the coupling point D of the second stage ring resonator 33*b* through a coupling capacitor, a phase-shifting circuit 93 of which one end is coupled to the coupling point B of the second stage ring resonator 33*b* through a coupling capacitor and the other end is coupled to the coupling point D of the third stage ring resonator 33*c* through a coupling capacitor, and a phase-shifting circuit 94 of which one end is coupled to the coupling point C of the third stage ring resonator 33*c* through a coupling capacitor and the other end is coupled to the coupling point B of the third stage ring resonator 33*c* through a coupling capacitor.

The coupling point C of the first-stage ring resonator 33*a* is coupled to the coupling point A of the second-stage ring resonator 33*b* through an inter-stage coupling capacitor 95, and the coupling point C of the second-stage ring resonator 33*b* is coupled to the coupling point A of the third-stage ring resonator 33*c* through an inter-stage coupling capacitor 96.

The microwaves transmitting through the phase-shifting circuit 92 shift by a specific angle $\phi 3$, the microwaves transmitting through the phase-shifting circuit 93 shift by a specific angle $\phi 2$, and the microwaves transmitting through the phase-shifting circuit 94 shift by a specific angle $\phi 1$. The specific angles $\phi 1$, $\phi 2$, and $\phi 3$ are respectively equal to a multiple of 180 degrees in the electric length (a half-wave length of the microwaves). Each of the phase-shifting circuits 92, 93, and 94 is formed of the strip line 52, the parallel-connected inductor 62, a combination unit of the serially-connected inductor 72 and the parallel-connected capacitors 73, 74, a combination unit of the amplifier 82 and the strip line 83, or a combined element thereof as shown in FIGS. 5–8.

In the above configuration, microwaves transferred from the input terminal 32*a* to the coupling point A of the first-stage ring resonator 33*a* are circulated and resonated in the first-stage ring resonator 33*a*. Thereafter, the intensity of the electric field at the coupling point C of the first-stage ring resonator 33*a* is increased to a maximum value. Therefore, the microwaves are transferred to the coupling point A of the second-stage ring resonator 33*b* through the inter-layer coupling capacitor 95. Thereafter, the microwaves are again circulated and resonated in the second-stage ring resonator 33*b*. Thereafter, the intensity of the electric field at the coupling point C of the second-stage ring resonator 33*b* is increased to a maximum value. Therefore, the microwaves are transferred to the coupling point A of the third-stage ring resonator 33*c* through the inter-layer coupling capacitor 96. Thereafter, the microwaves are again circulated and resonated in the third-stage ring resonator 33*c*. Thereafter, the intensity of the electric field at the coupling point C of the second-stage ring resonator 33*b* is increased to a maximum value. Therefore, the microwaves are transferred to the coupling point B through the phase-shifting circuit 94. Therefore, the characteristic impedance of the ring resonator 33*c* is changed by the phase-shifting circuit 94 functioning as a microwave transmitting line in the same manner as that of the strip line ring resonator 33 shown in FIG. 3.

Thereafter, the microwaves are again circulated and resonated in the third-stage ring resonator 33*c* and are transferred from the coupling point D of the third-stage ring resonator 33*c* to the coupling point B of the second-stage ring resonator 33*b* through the phase-shifting circuit 93. Therefore, the characteristic impedance of the ring resonator 33*b* is changed by the phase-shifting circuit 93 functioning as a microwave transmitting line. Thereafter, the microwaves are again circulated and resonated in the second-stage ring resonator 33*b* and are transferred from the coupling point D of the second-stage ring resonator 33*b* to the coupling point B of the first-stage ring resonator 33*a* through the phase-shifting circuit 92. Therefore, the characteristic impedance of the ring resonator 33*a* is changed by the phase-shifting circuit 92 functioning as a microwave transmitting line. Thereafter, the microwaves are again circulated and resonated in the first-stage ring resonator 33*a* and are output from the coupling point D of the first-stage ring resonator 33*a* to the output terminal 35*a* through the output coupling capacitor 33*a*.

Accordingly, because each of the ring resonators 33*a*, 33*b*, and 33*c* functions as a resonator and filter in dual mode, the multistage filter 91 can function as a six-stage filter.

Also, the frequency characteristics of the microwaves in which the intensity of the microwaves is sharply risen at a resonance frequency $\omega_o$ relating to the resonance wavelength $\lambda_o$ can be obtained because the multistage filter 91 functions as the six-stage filter. In other words, the multistage filter 91 functions as an elliptic filter of which frequency characteristics are expressed according to an elliptic function.

Also, a resonance width of the microwaves can be suitably adjusted with the phase-shifting circuits 92, 93, 94.

In the fifth embodiment, the number of the ring resonators 33 arranged in series is three. However, the number of the ring resonators 33 arranged in series is not limited to three. That is, it is applicable that a series of ring resonators be arranged. In this case, microwaves circulated in a ring resonator arranged in an N-th stage (N is an integral number) are transferred from a first coupling point (equivalent to the coupling point C) of the ring resonator to a second coupling point (equivalent to the coupling point A) of another ring resonator arranged in an (N+1)-th stage. Also, microwaves circulated in a ring resonator arranged in an M-th stage (M is an integral number) are transferred from a third coupling point (equivalent to the coupling point D) of the ring resonator to a fourth coupling point (equivalent to the coupling point B) of another ring resonator arranged in an (M−1)-th stage.

Next, a sixth embodiment of the first concept is described.

Figure 10:
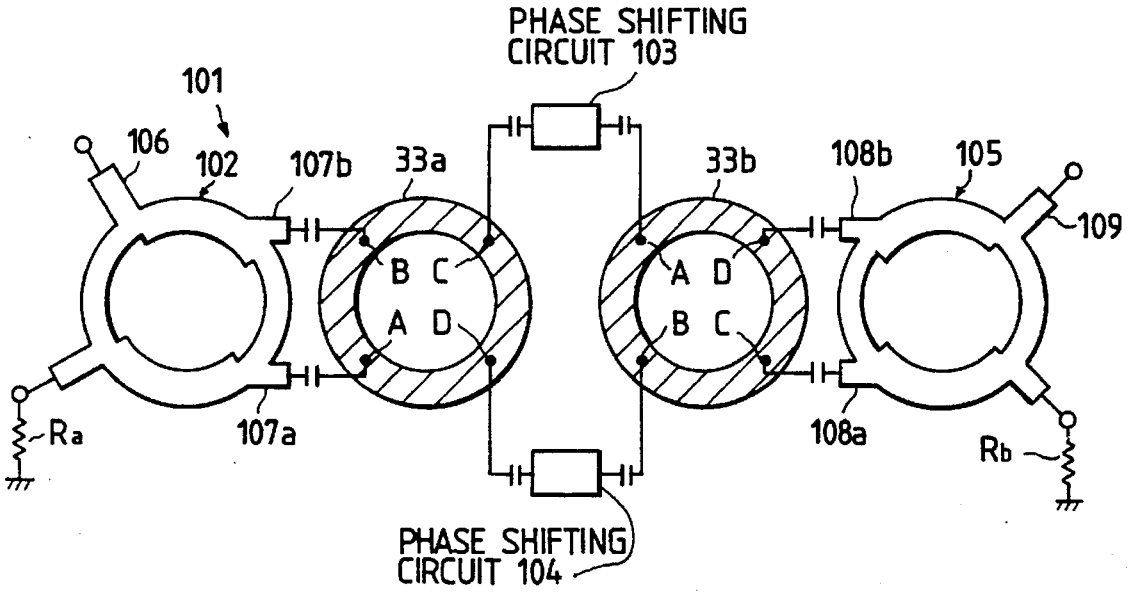
FIG. 10 is a plan view of a dual mode multistage filter according to a sixth embodiment of the first concept shown in FIGS. 3, 4A.

FIG. 10 is a plan view of a dual mode multistage filter according to a sixth embodiment of the first concept.

As shown in FIG. 10, a dual mode multistage filter 101 comprises a 90 degrees hybrid ring coupler 102 for dividing microwaves into two divided microwaves of which a phase difference is 90 degrees, the ring resonator 33*a* in a first stage of which the coupling points A, B are coupled to the hybrid ring coupler 102 through coupling capacitors, the ring resonator 33*b* in a second stage, a phase-shifting circuit 103 of which one end is coupled to the coupling point C of the first stage ring resonator 33*a* through a coupling capacitor and another end is coupled to the coupling point A of the second stage ring resonator 33*b* through a coupling capacitor, a phase-shifting circuit 104 of which one end is coupled to the coupling point D of the first stage ring resonator 33*a* through a coupling capacitor and another end is coupled to the coupling point B of the second stage ring resonator 33*b* through a coupling capacitor, and a 90 degrees hybrid ring coupler 105 for matching the phases of the divided microwaves with each other and combining the divided microwaves into combined microwaves.

The hybrid ring coupler 102 is provided with an input terminal 106 for receiving the microwaves, a grounded resistor Ra, a first hybrid terminal 107*a* coupled to the coupling point A of the first-stage ring resonator 33*a*, and a second hybrid terminal 107*b* coupled to the coupling point B of the first-stage ring resonator 33*a*. The first hybrid terminal 107*a* is spaced 90 degrees in the electric length apart from the second hybrid terminal 107*b*.

The hybrid ring coupler 105 is provided with a first hybrid terminal 108*a* coupled to the coupling point C of the second-stage ring resonator 33*b*, and a second hybrid terminal 108*b* coupled to the coupling point D of the second-stage ring resonator 33*b*, a grounded resistor Rb, and an output terminal 109 for outputting the combined microwaves. The first hybrid terminal 108*a* is spaced 90 degrees in the electric length apart from the second hybrid terminal 108*b*.

In the above configuration, when the input terminal 106 is excited by the microwaves, the microwaves are circulated in the hybrid ring coupler 102 in clockwise and counterclockwise directions. In this case, because the phase of the microwaves circulated in the clockwise direction shifts by 180 degrees at the grounded resistor Ra as compared with the phase of the microwaves circulated in the counterclockwise direction, the microwaves circulated in the clockwise and counterclockwise directions are electromagnetically interfered and are not transferred to the grounded resistor Ra.

In contrast, the phase of the microwaves circulated in the clockwise direction agrees with the phase of the microwaves circulated in the counterclockwise direction at the first and second hybrid terminals 107*a*, 107*b*. Therefore, the microwaves are divided into first and second divided microwaves. The first divided microwaves are transmitted from the hybrid terminal 107*a* to the first-stage ring resonator 33*a*, and the second divided microwaves are transmitted from the hybrid terminal 107*b* to the first-stage ring resonator 33*a*. In this case, the intensity of the electric field induced by the first divided microwaves is maximized at the first hybrid terminal 107*a* and the intensity of the electric field induced by the second divided microwaves is maximized at the second hybrid terminal 107*b* because the phase of the first divided microwaves shifts by 90 degrees as compared with that of the second divided microwaves. Therefore, the first and second divided microwaves in orthogonal modes are circulated in the first-stage ring resonator 33*a* to resonate and filter the first and second divided microwaves. In addition, an intensity of the first divided microwaves agrees with another intensity of the second divided microwaves. Therefore, an electric power density of the first and second divided microwaves circulated in the first-stage ring resonator 33*a* is half as many as that of the microwaves at the input terminal 106.

Thereafter, the first divided microwaves are transferred to the coupling point A of the second-stage ring resonator 33*b* through the phase-shifting circuit 103. Also, the second divided microwaves are transferred to the coupling point B of the second-stage ring resonator 33*b* through the phase-shifting; circuit 104. Therefore, the first and second divided microwaves in the orthogonal modes are again circulated in the second-stage ring resonator 33*b* to resonate and filter the first and second divided microwaves.

Thereafter, the first divided microwaves are transferred to the hybrid ring coupler 105 through the first hybrid terminal 108*a*, and the second divided microwaves are transferred to the hybrid ring coupler 105 through the second hybrid terminal 108*b*. Thereafter, the phase of the first divided microwaves matches with that of the second divided microwaves in the hybrid ring coupler 105, and the first and second divided microwaves are combined into the combined microwaves at the output terminal 109.

Accordingly, because the first and second microwaves of which electric power densities are respectively reduced in half are circulated in the ring resonators 33*a*, 33*b*, and because the first and second divided microwaves independently coexist in the ring resonators 33*a*, 33*b*, the microwaves having a heavy electric power can be filtered in the multistage filter 101.

Also, in cases where each of the phase-shifting circuits 103, 104 is made of an electric power amplifier such as a combination of the amplifier 82 and the strip line 83, the multistage filter 101 can function as a filter of a heavy electric power amplifier in a parallel operation.

In the first to sixth embodiments of the first concept, the ring resonator 33 is in a single plate structure. However, it is preferred that the ring resonator 33 be formed in a multi-plate structure such as a tri-plate structure.

Also, the ring resonator 33 is formed of a balanced strip line shown in FIG. 4. However, it is preferred that the ring resonator 33 be formed of a microstrip.

Figure 13:
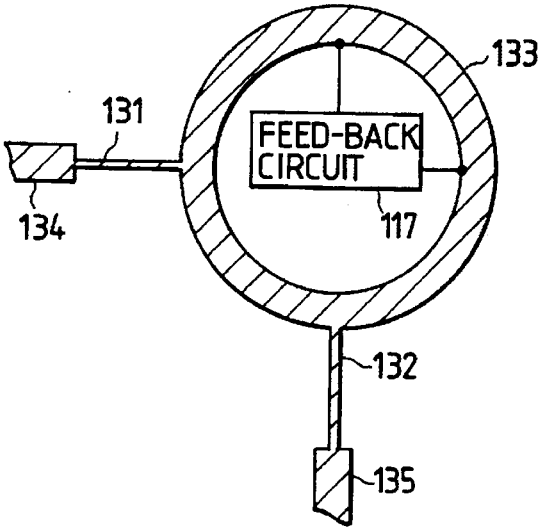
FIG. 13 is a plan view of a strip dual mode filter according to another modification of the first embodiment in the second concept.

Next, a first embodiment of a second concept is described with reference to FIGS. 11 to 13.

Figures 11, 12:
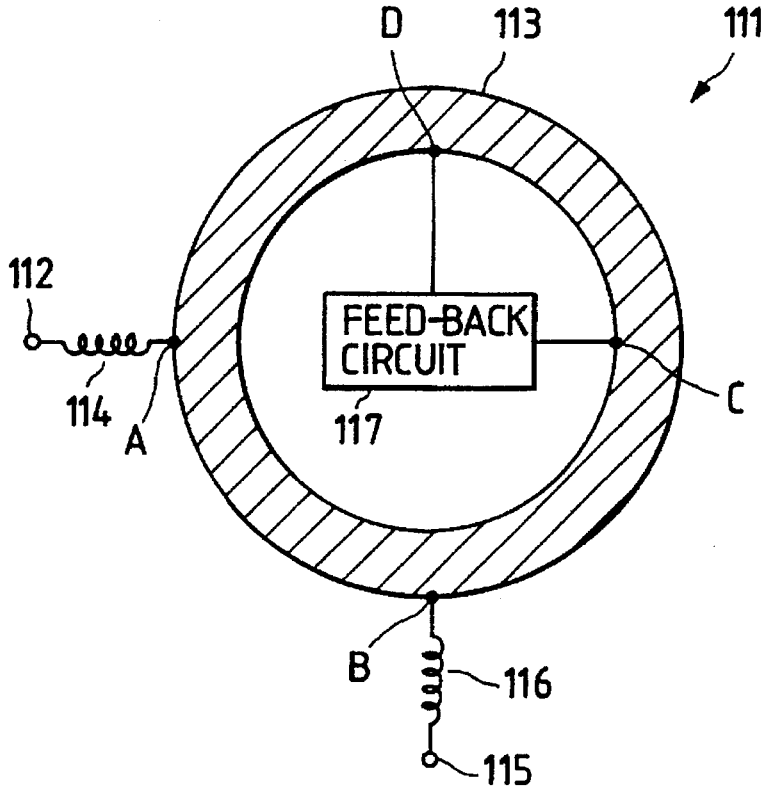
FIG. 11 is a plan view of a strip dual mode filter according to a first embodiment of a second concept.
FIG. 12 shows attenuation of the microwaves in the strip dual mode filter in tabular form.

FIG. 11 is a plan view of a strip dual mode filter according to a first embodiment of a second concept.

As shown in FIG. 11, a strip dual mode filter 111 comprises an input terminal 112 excited by microwaves, a strip line ring resonator 113 in which the microwaves are resonated, an input coupling inductor 114 connecting the input terminal 112 and a coupling point A of the ring resonator 113 to couple the input terminal 112 excited by the microwaves to the ring resonator 113 in inductive coupling, an output terminal 115 which is excited by the microwaves resonated in the ring resonator 113, an output coupling inductor 116 connecting the output terminal 115 and a coupling point B of the ring resonator 113 to couple the output terminal 115 to the ring resonator 113 in inductive coupling, and a feed-back circuit 117 connected to a connecting point C and a connecting point D of the ring resonator 113.

The ring resonator 113 has a uniform line impedance. Also, the ring resonator 113 has an electric length equivalent to a resonance wavelength $\lambda_o$.

The coupling point B is spaced 90 degrees in the electric length (or a quarter-wave length of the microwaves) apart from the coupling point A. The connecting point C is spaced 180 degrees (or a half-wave length of the microwaves) apart from the coupling point A. The connecting point D is spaced 180 degrees apart from the coupling point B.

The feed-back circuit 117 is arranged in a central hollow space of the ring resonator 113, and is made of passive or active elements such as a capacitor, an inductor, a strip line, an amplifier, a combination unit of those elements, or the like. For example, the feed-back circuit 117 is formed of the strip line 52 shown in FIG. 5, the parallel-connected inductor 62 shown in FIG. 6, a combination unit of the serially-connected inductor 72 and the parallel-connected capacitors 73, 74 shown in FIG. 7, or a combination unit of the amplifier 82 and the phase correcting strip line 83 shown in FIG. 8. In addition, an inlet coupling inductor (not shown) is arranged at an inlet of the feed-back circuit 117 to couple the circuit 117 to the coupling point C in inductive coupling, and an outlet coupling inductor (not shown) is arranged at an outlet of the feed-back circuit 117 to couple the circuit 117 to the coupling point D in inductive coupling. Therefore, the phase of the microwaves transferred from the connecting point C to the feed-back circuit 117 shifts by a multiple of a half-wave length of the microwaves before the microwaves are transferred to the connecting point D.

In the above configuration, when the input terminal 112 is excited by microwaves having various wavelengths around the resonance wavelength $\lambda_o$, magnetic field is induced around the input coupling inductor 114 so that the intensity of the magnetic field at the coupling point A of the fine resonator 113 is increased to a maximum value. Therefore, the input terminal 112 is coupled to the ring resonator 113 in the inductive coupling, and the microwaves are transferred from the input terminal 112 to the coupling point A of the fine resonator 113. Thereafter, the microwaves are circulated in the ring resonator 113 in clockwise and counterclockwise directions. In this case, the microwaves having the resonance wavelength $\lambda_o$ are selectively resonated.

The intensity of the magnetic field induced by the microwaves resonated is minimized at the coupling point B because the coupling point B is spaced 90 degrees in the electric length apart from the coupling point A. Therefore, the microwaves are not transferred to the output terminal 115. Also, the intensity of the magnetic field is minimized at the connecting point D spaced 90 degrees in the electric length apart from the coupling point A so that the microwaves are not transferred from the connecting point D to the feed-back circuit 117. In contrast, because the connecting point C is spaced 180 degrees in the electric length apart from the coupling point A, the intensity of the magnetic field at the connecting point C is maximized. Therefore, the microwaves circulated in the ring resonator 113 are transferred from the connecting point C to the feed-back circuit 117.

In the feed-back circuit 117, the phase of the microwaves shifts a multiple of a half-wave length of the microwaves to produce phase-shift microwaves. Thereafter, the phase-shift microwaves are transferred to the connecting point D. Therefore, the intensity of the magnetic field at the coupling point D is increased to the maximum value. Thereafter, the phase-shift microwaves are circulated in the ring resonator 113 in the clockwise and counterclockwise directions to resonate the phase-shift microwaves according to a characteristic impedance of the strip dual mode filter 111. The characteristic impedance depends on the line impedance of the ring resonator 113 and a characteristic impedance of the feed-back circuit 117. Thereafter, because the coupling point B is spaced 180 degrees in the electric length apart from the connecting point D, the intensity of the magnetic field is increased at the coupling point B. Therefore, magnetic field is induced around the output coupling inductor 116, so that the output terminal 115 is coupled to the connecting point B in the inductive coupling. Thereafter, the phase-shift microwaves are transferred from the connecting point B to the output terminal 115.

Accordingly, because the microwaves having the resonance wavelength $\lambda_o$ are selectively resonated in the ring resonator 113 and are transferred to the output terminal 115, the strip dual mode filter 111 functions as a resonator and filter.

The microwaves transferred from the input terminal 112 are initially circulated in the ring resonator 113, and the phase-shift microwaves are again circulated in the ring resonator 113. Also, a phase difference between the phase-shift microwaves and the microwaves is 90 degrees. Therefore, two orthogonal modes in which the microwaves and the phase-shift microwaves are resonated independently coexist in the ring resonator 113. Therefore, the strip dual mode filter 111 functions as a dual mode filter.

Also, because the strength of the phase-shift microwaves transferred to the output terminal 115 can be adjusted by changing the characteristic impedance of the feed-back circuit 117, and because the feed-back circuit 117 can be selected from the various types of passive and active elements shown in FIGS. 5 to 8, the characteristic impedance of the strip dual mode filter 111 can be suitably set.

Also, because a resonance width of the microwaves resonated in the ring resonator 113 mainly depends on the characteristic impedance of the feed-back circuit 117, the resonance width can be suitably adjusted by changing the characteristic impedance of the feed-back circuit 117.

Also, in cases where the feed-back circuit 117 is formed of one or more active elements, a tuning filter having an amplifying function or an electric power amplifier can be manufactured.

Next, the attenuation of harmonic components of the microwaves such as a secondary harmonic component $2F_o$, a tertiary harmonic component $3F_o$, a fourth-degree harmonic component $4F_o$, and a fifth-degree harmonic component $5F_o$ is shown in FIG. 12 as an example to describe functions of the input and output coupling inductors 114, 116. A frequency of the secondary harmonic component $2F_o$ is twice as many as that of a fundamental component of the microwaves, a frequency of the tertiary harmonic component $3F_o$ is three times as many as that of the fundamental component, a frequency of the fourth-degree harmonic component $4F_o$ is four times as many as that of the fundamental component, and a frequency of the fifth-degree harmonic component $5F_o$ is five times as many as that of the fundamental component.

To obtain the attenuation of the harmonic components of the microwaves according to the first embodiment of the second concept, the feed-back circuit 117 is formed of a strip line having a length 0.1 mm, an inductance of each of the input and output coupling inductors 114, 116 is set to 11.1 nH, and a capacitance of each of capacitors arranged at inlet and outlet sides of the feed-back circuit 117 is set to 0.25 pF. In this case, the capacitors are arranged at the inlet and outlet sides of the feed-back circuit 117 to compare with a conventional filter. Also, the ring resonator 113 has a relative dielectric constant $\epsilon_r$=10 and a thickness H=1.25 mm. In contrast, to obtain the attenuation of the harmonic components of the microwaves in the conventional filter, the input and output coupling inductors 114, 116 are exchanged for input and output coupling capacitors respectively having a capacitance 0.46 pF.

As shown in FIG. 12 the harmonic components of the microwaves according to the first embodiment of the second concept is considerably attenuated as compared with those in the conventional filter.

Accordingly, because the input and output coupling inductors 114, 116 are utilized in the strip dual mode filter 111, the harmonic components of the microwaves can be prevented from being resonated in the ring resonator 113 as compared with those in the strip dual mode filter 31 in which the input and output coupling capacitors 34, 36 are utilized. In other words, the fundamental component of the microwaves can dominantly transmit through the input and output coupling inductors 114, 116.

In the first embodiment of the second concept, each of the inductors 114, 116 has a lumped inductance. However, as shown in FIG. 13, it is preferred that strip coupling lines 131, 132 respectively having a narrow width be utilized in place of the inductors 114, 116. Also, to obtain a widened resonance width of the microwaves, it is preferred that a strip line ring resonator 133 having a narrowed width be utilized in place of the ring resonator 113. In this case, strip lines 134, 135 are utilized in place of the input and output terminals 112, 115. Also, sizes of the strip lines 131, 132 are determined to achieve impedance matching between the strip lines 131, 132 and the ring resonator 133.

Next, a second embodiment of a second concept is described with reference to FIGS. 14, 15.

Figure 14:
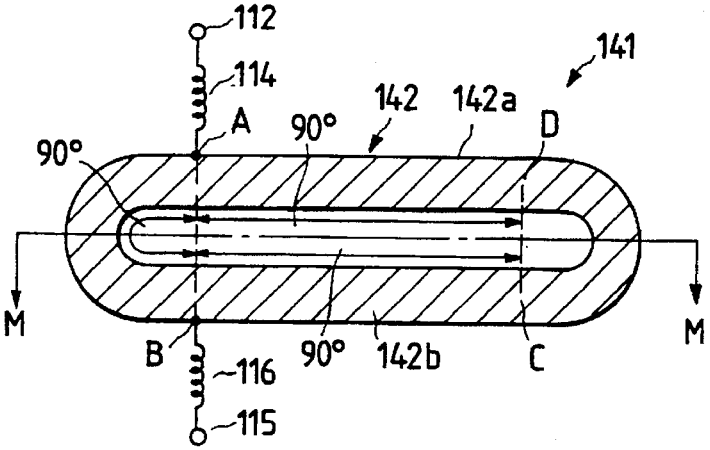
FIG. 14 is a plan view of a strip dual mode filter according to a second embodiment of the second concept.
Figure 15:
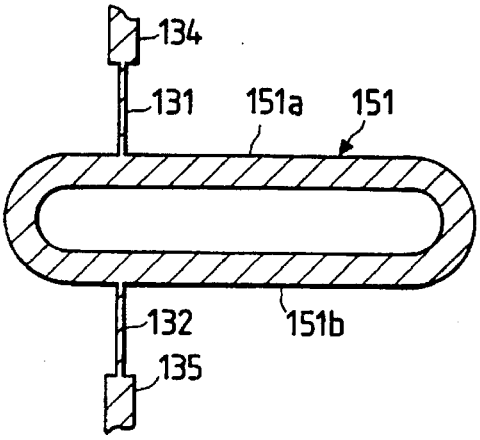
FIG. 15 is a plan view of a strip dual mode filter according to another modification of the second embodiment in the second concept.

FIG. 14 is a plan view of a strip dual mode filter according to a second embodiment of a second concept.

As shown in FIG. 14, a strip dual mode filter 141 comprises the input terminal 112, the input coupling inductor 114, a strip line loop resonator 142 having a pair of straight strip lines **142*a*, 142*b* arranged in parallel in which the microwaves are resonated, the output terminal 115, and the output coupling inductor 116**.

The loop resonator 142 has a uniform line impedance and an electric length equivalent to a resonance wavelength $\lambda_o$.

Also, the straight strip lines 142*a*, 142*b* are coupled to each other in electromagnetic coupling because the straight strip lines 142*a*, 142*b* are closely positioned. Therefore, a characteristic impedance of the strip dual mode filter 141 depends on both the line impedance of the loop resonator 142 and the electromagnetic coupling between the straight strip lines 142*a*, 142*b*. As a result, the electromagnetic coupling functions in the same manner as the feed-back circuit 117 shown in FIG. 11.

A coupling point A at which the loop resonator 142 and the input coupling inductor 114 is connected is spaced 90 degrees in the electric length apart from a coupling point B at which the loop resonator 142 and the output coupling inductor 116 is connected. Also, the coupling points A, B are symmetrically placed with respect to a middle line M positioned between the straight strip lines 142*a*, 142*b*.

In the above configuration, after microwaves having various wavelengths around the resonance wavelength $\lambda_o$ are transferred to the coupling point A of the loop resonator 142, the microwaves are circulated in the loop resonator 142 in clockwise and counterclockwise directions according to the characteristic impedance of the loop resonator 142. In this case, the microwaves having the resonance wavelength $\lambda_o$ are resonated in a first resonance mode without being reflected in the straight strip lines 142*a*, 142*b*. The intensity of the magnetic field induced by the microwaves resonated is maximized at the coupling point A and a first point C spaced 180 degrees in the electric length apart from the coupling point A.

Thereafter, because the straight strip lines 142*a*, 142*b* are coupled to each other, the phase of the microwaves shifts by 90 degrees in the straight strip lines 142*a*, 142*b*. Thereafter, the microwaves are again circulated and resonated in the loop resonator 142 in a second resonance mode orthogonal to the first resonance mode. In this case, the intensity of the magnetic field induced by the microwaves according to the second resonance mode is maximized at the coupling point B and a second point D spaced 180 degrees in the electric length apart from the coupling point B. Thereafter, the microwaves are transferred from the coupling point B to the output terminal 115 by the action of the output coupling inductor 116.

Accordingly, because two orthogonal modes consisting of the first and second resonance modes independently coexist in the loop resonator 142, the microwaves having the resonance wavelength $\lambda_o$ are selectively resonated twice in the loop resonator 142. Therefore, the strip dual mode filter 141 functions as a dual mode filter.

Also, because the strength of the microwaves transferred to the output terminal 115 can be adjusted by changing the strength of the electromagnetic coupling between the straight strip lines 142*a*, 142*b*, the characteristic impedance of the strip dual mode filter 141 can be suitably set. The strength of the electromagnetic coupling depends on lengths of the straight strip lines 142*a*, 142*b*, widths of the straight strip lines 142*a*, 142*b*, and a distance between the straight strip lines 142*a*, 142*b*.

Also, because a resonance width of the microwaves resonated in the loop resonator 142 mainly depends on the strength of the electromagnetic coupling, the resonance width can be adjusted by changing the strength of the electromagnetic coupling.

In addition, because the input and output coupling inductors 114, 116 are utilized in the strip dual mode filter 141, the harmonic components of the microwaves can be prevented from being resonated in the loop resonator 142 in the same manner as the strip dual mode filter 111 shown in FIG. 11.

In the second embodiment of the second concept, each of the inductors 114, 116 has a lumped inductance. However, as shown in FIG. 15, it is preferred that the strip coupling lines 131, 132 respectively having a narrow width be utilized in place of the inductors 114, 116 and the strip lines 134, 135 be utilized in place of the input and output terminals 112, 115. Also, to obtain a widened resonance width of the microwaves, it is preferred that a strip line loop resonator 151 having a narrowed width be utilized in place of the loop resonator 142. In this case, straight strip lines 151*a*, 151*b* of the loop resonator 151 are dominantly coupled to each other in inductive coupling.

In the first and second embodiments of the second concept, the ring resonators 113, 133 and the loop resonators 142, 151 are in a single plate structure. However, it is preferred that the ring and loop resonators be formed in a multi-plate structure such as a tri-plate structure.

Also, the ring and loop resonators 113, 133, 142, 151 are formed of a balanced strip line. However, it is preferred that the ring and loop resonators be formed of a microstrip.

Next, a first embodiment of a third concept is described with reference to FIGS. 16, 17.

Figure 16:
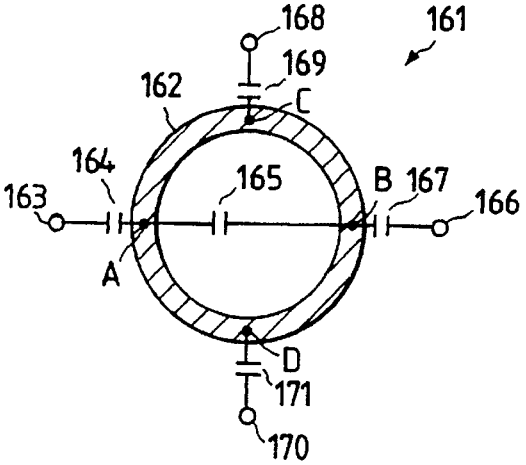
FIG. 16 is a plan view of a strip dual mode filter according to a first embodiment of a third concept.
Figure 17:
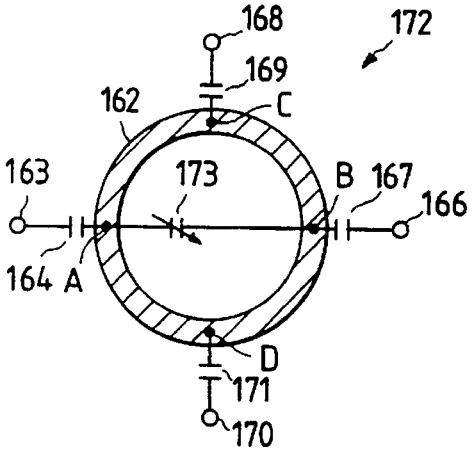
FIG. 17 is a plan view of a strip dual mode filter according to another modification of the first embodiment in the third concept.

FIG. 16 is a plan view of a strip dual mode filter according to a first embodiment of a third concept.

As shown in FIG. 16, a strip dual mode filter 161 comprises a strip line ring resonator 162 having a line length L1 for resonating first microwaves having various frequencies around a first frequency F1 and second microwaves having various frequencies around a second frequency F2, a first input terminal 163 excited by the first microwaves, a first input coupling capacitor 164 for coupling the first input terminal 163 to a coupling point A of the ring resonator 162 in capacitive coupling, a first resonance capacitor 165 for coupling the coupling point A to a coupling point B spaced a half-line length L½ apart from the coupling point A to change a first characteristic impedance of the ring resonator 162, a first output terminal 166 excited by the first microwaves which are resonated in the ring resonator 162, a first output coupling capacitor 167 for coupling the first output terminal 166 to the coupling point B in capacitive coupling, a second input terminal 168 excited by the second microwaves, a second input coupling capacitor 169 for coupling the second input terminal 168 to a coupling point C of the ring resonator 162 spaced a quarter-line length L¼ apart from the coupling point A in capacitive coupling, a second output terminal 170 excited by the second microwaves which are resonated in the ring resonator 162 according to a second characteristic impedance of the ring resonator 162, and a second output coupling capacitor 171 for coupling the second output terminal 170 to a coupling point D of the ring resonator 162 spaced the half-line length L½ apart from the coupling point C in capacitive coupling.

The ring resonator 162 has a uniform line impedance, and the first characteristic impedance of the ring resonator 162 depends on the uniform line impedance of the ring resonator 162 and a first capacitance $C_1$ of the first resonance capacitor 165. In contrast, the second characteristic impedance of the ring resonator 162 depends on the uniform line impedance of the ring resonator 162.

The input and output coupling capacitors 164, 167, 169, and 171 and the first coupling capacitor 165 are respectively formed of a plate capacitor or a chip capacitor having a lumped capacitance.

In the above configuration, the first capacitance $C_1$ of the first resonance capacitor 165 is determined in advance to resonate the first microwaves at a first resonance frequency $\omega_{o1}$ agreeing with the first frequency F1 in the ring resonator 162 according to the first characteristic impedance of the ring resonator 162.

Thereafter, the first microwaves are transferred to the coupling point A of the ring resonator 162 when the first input terminal 163 is excited by the first microwaves. Thereafter, the first microwaves are circulated in the ring resonator 162 according to the first characteristic impedance. In this case, a part of the first microwaves transmit through the first resonance capacitor 165. Therefore, even though the electric length of the ring resonator 162 does not agree with a first wavelength relating to the first frequency F1 of the first microwaves, the first microwaves are resonated at the first frequency F1 in the ring resonator 162 according to a first resonance mode, and the intensity of the electric field induced by the first microwaves is maximized at the coupling point B. Thereafter, the first microwaves resonated are transferred to the first output terminal 166 through the first output coupling capacitor 167. As a result, the first microwaves are resonated and filtered in the strip dual mode filter 161 to have the first resonance frequency $\omega_{01}$ agreeing with the first frequency F1 of the first microwaves.

Also, the second microwaves are transferred to the coupling point C of the ring resonator 162 when the second input terminal 168 is excited by the second microwaves. In this case, the transference of the second microwaves is independent of that of the first microwaves: Thereafter, the second microwaves of the second frequency F2 are circulated in the ring resonator 162 according to the second characteristic impedance. In this case, when a wavelength of the second microwaves relating to the second frequency F2 agrees with the electric length of the ring resonator 162, the second microwaves are resonated in the ring resonator 162 according to a second resonance mode orthogonal to the first resonance mode, and the intensity of the electric field induced by the second microwaves is maximized at the coupling point D. Thereafter, the second microwaves resonated are transferred to the second output terminal 170 through the second output coupling capacitor 171. As a result, the second microwaves are resonated and filtered in the strip dual mode filter 161 to have a second resonance frequency $\omega_{02}$ agreeing with the second frequency F2 of the second microwaves.

Accordingly, because the first and second resonance modes orthogonal to each other independently coexist in the ring resonator 162, the first microwaves of the first frequency F1 and the second microwaves of the second frequency F2 can be simultaneously resonated and filtered in the strip dual mode filter 161.

Also, because the first resonance capacitor 165 having the first capacitance $C_1$ is arranged in the filter 161, a first resonance wavelength $\lambda_{o1}$ relating to the first resonance frequency $\omega_{o1}$ can be longer than the electric length of the ring resonator 162. For example, in cases where the uniform line impedance of the ring resonator 162 is 50 Ω and the second frequency F2 of the second microwaves is almost 900 MHz, the first microwaves are resonated at the first frequency 800 MHz on condition that the first capacitance $C_1$ of the first resonance capacitor 165 equals 0.5 pF.

Accordingly, the size of the filter 161 can be greatly minimized regardless of the first resonance wavelength $\lambda_{o1}$ even though the resonance wavelength $\lambda_{o1}$ is set to a value longer than the wavelength of the second microwaves.

Also, because the first characteristic impedance depends on the first capacitance $C_1$ of the first resonance capacitor 165, a first resonance width of the first microwaves can be suitably set to a designed value.

In the first embodiment of the third concept, the first capacitance $C_1$ of the first coupling capacitor 165 is fixed. However, as a strip dual mode filter 172 is shown in FIG. 17, it is preferred that a first variable coupling capacitor 173 be utilized in place of the first coupling capacitor 165. In this case, because a capacitance of the first variable coupling capacitor 173 is variable, the capacitance of the first variable coupling capacitor 173 can be minutely adjusted after the filter 172 are manufactured, even though the capacitance of the first variable coupling capacitor 173 is slightly out of designed values. Accordingly, a yield rate of the filter 172 can be increased as compared with the filter 161.

Next, a second embodiment of the third concept is described with reference to FIGS. 18, 19.

Figure 18:
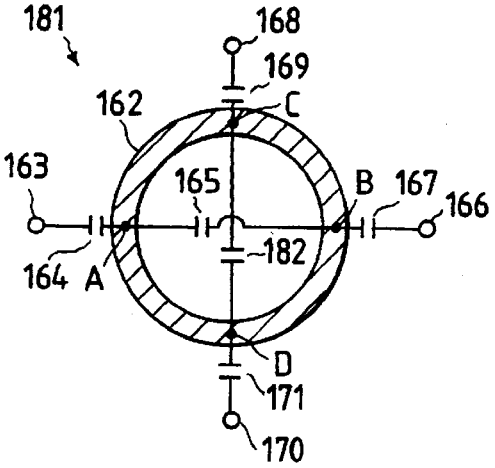
FIG. 18 is a plan view of a strip dual mode filter according to a second embodiment of the third concept.
Figure 19:
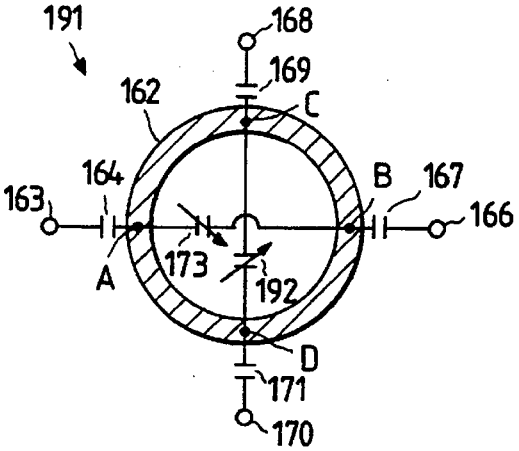
FIG. 19 is a plan view of a strip dual mode filter according to another modification of the second embodiment in the third concept.

FIG. 18 is a plan view of a strip dual mode filter according to a second embodiment of the third concept.

As shown in FIG. 18, a strip dual mode filter 181 comprises the strip line ring resonator 162 for resonating the first microwaves and third microwaves having various frequencies around a third frequency F3, the first input terminal 163, the first input coupling capacitor 164, the first resonance capacitor 165 for changing a first characteristic impedance of the ring resonator 162, the first output terminal 166, the first output coupling capacitor 167, the second input terminal 168 excited by the third microwaves, the second input coupling capacitor 169, a second resonance capacitor 182 for coupling the coupling point C to the coupling point D to change a second characteristic impedance of the ring resonator 162, the second output terminal 170, and the second output coupling capacitor 171.

Th second characteristic impedance of the ring resonator 162 depends on the uniform line impedance of the ring resonator 162 and a second capacitance $C_2$ of the second resonance capacitor 182.

The second coupling capacitor 182 is formed of a plate capacitor or a chip capacitor having a lumped capacitance.

In the above configuration, the second capacitance C2 of the second resonance capacitor 182 is determined in advance to resonate the third microwaves at a third resonance frequency $\omega_{o3}$ agreeing with the third frequency F3 in the ring resonator 162 according to the second characteristic impedance of the ring resonator 162, in the same manner as the first capacitance $C_1$ of the first resonance capacitor 165.

Thereafter, the first microwaves are resonated and filtered at the third resonance frequency $\omega_{o1}$ in the strip dual mode filter 181, in the same manner as in the filter 161.

Also, the third microwaves are transferred to the coupling point C of the ring resonator 162 when the second input terminal 168 is excited by the third microwaves. In this case, the transference of the third microwaves is independent of that of the first microwaves. Thereafter, the third microwaves are circulated in the ring resonator 162 according to a third characteristic impedance of the ring resonator 162. In this case, a part of the third microwaves transmit through the second resonance capacitor 182. Therefore, even though the electric length of the ring resonator 162 does not agree with a third wavelength relating to the third frequency F3 of the third microwaves, the third microwaves are resonated in the ring resonator 162 according to a third resonance mode orthogonal to the first resonance mode, and the intensity of the electric field induced by the third microwaves is maximized at the coupling point D. Thereafter, the third microwaves resonated are transferred to the second output terminal 170 through the second output coupling capacitor 171.

As a result, the third microwaves are resonated and filtered in the strip dual mode filter 181 to have the third resonance frequency $\omega_{o3}$.

Accordingly, because the first and third resonance modes orthogonal to each other independently coexist in the ring resonator 162, the first microwaves of the first frequency F1 and the third microwaves of the third frequency F3 can be simultaneously resonated and filtered in the strip dual mode filter 181.

Also, because the first resonance capacitor 165 having the first capacitance $C_1$ is arranged in the filter 181, a resonance wavelength $\lambda_{o1}$ relating to the first resonance frequency $\omega_{o1}$ can be longer than the electric length of the ring resonator 162. In the same manner, because the second resonance capacitor 182 having the second capacitance $C_2$ is arranged in the filter 181, a third resonance wavelength $\lambda_{o3}$ relating to the third resonance frequency $\omega_{o3}$ can be longer than the electric length of the ring resonator 162. Accordingly, the size of the filter 181 can be greatly minimized regardless of the first resonance wavelength $\lambda_{o1}$ and the third resonance wavelength $\lambda_{o3}$.

Also, because the first characteristic impedance and the second characteristic impedance depend on the first and second capacitances $C_1$, $C_2$ of the first and second resonance capacitors 165, 182, a first resonance width of the first microwaves can be suitably set to a designed value, and a third resonance width of the third microwaves can be suitably set to another designed value.

Also, though a horizontal line connecting the coupling points A, B through the first coupling capacitor 165 crosses a vertical line connecting the coupling points C, D through the second coupling capacitor 182 with an overcross in FIG. 18, it is allowed that the horizontal line intersects the vertical line because the first and third resonance modes are independent of each other. Accordingly, the first microwaves and the third microwaves can transmit through the same plane. In other words, a large number of filters 181 can be easily piled up.

In the second embodiment of the third concept, the first and second capacitances $C_1$, $C_2$ of the first and second coupling capacitors 165, 182 are fixed. However, as a strip dual mode filter 191 is shown in FIG. 19, it is preferred that the first variable coupling capacitor 173 and a second variable coupling capacitor 192 be utilized in place of the first and second coupling capacitors 165, 182. In this case, because capacitances of the first and second variable coupling capacitors 173, 192 are variable, the capacitances of the first and second variable coupling capacitors 173, 192 can be minutely adjusted after the filter 191 is manufactured, even though the capacitances of the first and second variable coupling capacitors 173, 192 are slightly out of designed values. Accordingly, a yield rate of the filter 191 can be increased as compared with the filter 181.

In the first and second embodiments of the third concept, the input and output coupling capacitors 164, 167, 169, and 171 and the first and second coupling capacitors. 165, 182 respectively have a lumped capacitance. However, it is preferred that inductors respectively having a lumped inductance be utilized in place of the input and output coupling capacitors 164, 167, 169, and 171 and the first and second coupling capacitors 165, 182. Also, it is preferred that gap capacitors respectively having a distributed capacitance be utilized in place of the input and output coupling capacitors 164, 167, 169, and 171. Also, it is preferred that strip lines respectively having a narrowed width be arranged around the ring resonator 162 to couple to the ring resonator 162 in inductive coupling, in place of the input and output coupling capacitors 164, 167, 169, and 171. Also, it is preferred that strip lines respectively having a distributed capacity or inductance be arranged in place of the first and second coupling capacitors 165, 182.

Next, a third embodiment of the third concept is described with reference to FIGS. 20, 21.

Figure 20A:
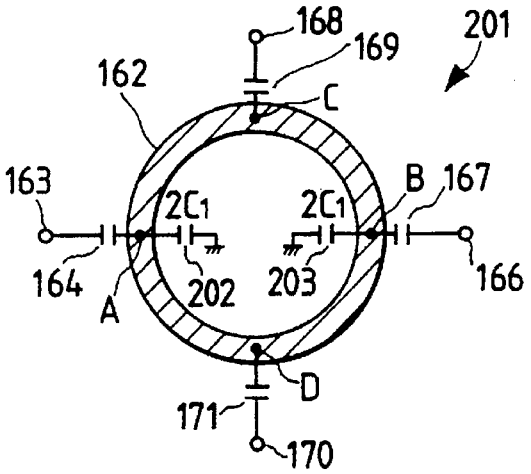
FIG. 20A is a plan view of a strip dual mode filter according to a third embodiment of the third concept.
Figure 21:
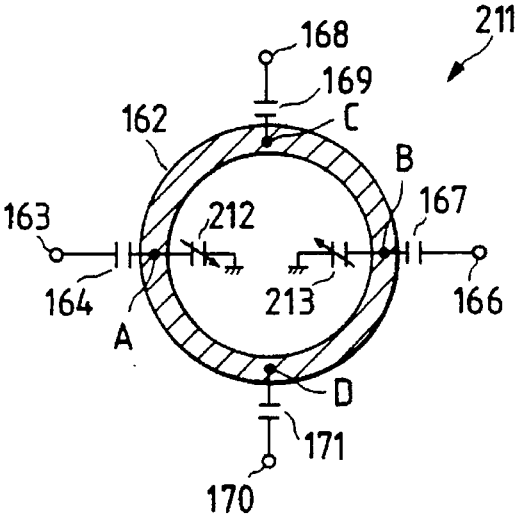
FIG. 21 is a plan view of a strip dual mode filter according to another modification of the third embodiment in the third concept.

FIG. 20A is a plan view of a strip dual mode filter according to a third embodiment of the third concept.

As shown in FIG. 20A, a strip dual mode filter 201 comprises the strip line ring resonator 162 for resonating the first microwaves and the second microwaves, the first input terminal 163, the first input coupling capacitor 164, a first inlet grounded capacitor 202 of which one end is connected to the coupling point A and another end is grounded, a first outlet grounded capacitor 203 of which one end is connected to the coupling point B and another end is grounded, the first output terminal 166, the first output coupling capacitor 167, the second input terminal 168 excited by the second microwaves, the second input coupling capacitor 169, the second output terminal 170, and the second output coupling capacitor 171.

Figure 20B:
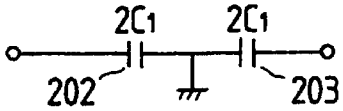
FIG. 20B shows a series of capacitors substantially agreeing with a pair of grounded capacitors shown in FIG. 20A.
Figure 20C:
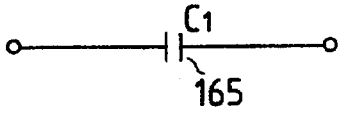
FIG. 20C shows an electric circuit equivalent to the capacitors shown in FIG. 20B.

The first inlet and outlet grounded capacitors 202, 203 respectively have a capacitance $2C_1$ which is twice as many as the capacitance $C_1$ of the first coupling capacitor 165. Also, as shown in FIG. 20B, the inlet and outlet grounded capacitors 202, 203 are substantially connected in series. Therefore, an electric circuit formed of the inlet and outlet grounded capacitors 202, 203 is equivalent to the capacitor 165 having the capacity $C_1$ as shown in FIG. 20C.

Accordingly, the strip dual mode filter 201 functions in the same manner as the strip dual mode filter 161 shown in FIG. 16.

In the third embodiment of the third concept, the capacitance $2C_1$ of each of the inlet and outlet grounded capacitors 202, 203 are fixed. However, as a strip dual mode filter 211 is shown in FIG. 21, it is preferred that variable grounded capacitors 212, 213 be utilized in place of the inlet and outlet grounded capacitors 202, 203. In this case, because capacitances of the variable grounded capacitors 212, 213 are variable, the capacitances of the variable grounded capacitors 212, 213 can be minutely adjusted after the filter 211 is manufactured, even though the capacitances of the variable grounded capacitors 212, 213 are slightly out of designed values. Accordingly, a yield rate of the filter 211 can be increased as compared with the filter 201.

Next, a fourth embodiment of the third concept is described with reference to FIGS. 22A, 22B.

Figure 22A:
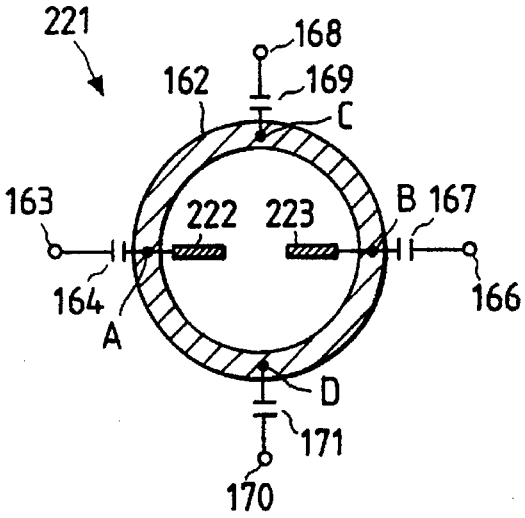
FIG. 22A is a plan view of a strip dual mode filter according to a fourth embodiment of the third concept.
Figure 22B:
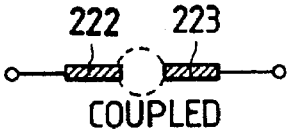
FIG. 22B shows a pair of strip lines coupled to each other, the strip lines being substantially equivalent to open end strip lines shown in FIG. 22A.

FIG. 22A is a plan view of a strip dual mode filter according to a fourth embodiment of the third concept.

As shown in FIG. 22A, a strip dual mode filter 221 comprises the strip line ring resonator 162 for resonating the first microwaves and the second microwaves, the first input terminal 163, the first input coupling capacitor 164, a first inlet open end strip line 222 connected at the coupling point A, a first outlet open end strip line 223 connected at the coupling point B, the first output terminal 166, the first output coupling capacitor 167, the second input terminal 168 excited by the second microwaves, the second input coupling capacitor 169, the second output terminal 170, and the second output coupling capacitor 171.

The first inlet and outlet open end strip lines 222, 223 respectively have a distributed capacitance $2C_1$ which is twice as many as the capacitance $C_1$ of the first coupling capacitor 165. Also, as shown in FIG. 22B, the inlet and outlet open end strip lines 222, 223 are substantially replaced with a pair of strip lines coupled to each other. Therefore, an electric circuit formed of the inlet and outlet open end strip lines 222, 223 is equivalent to the capacitor 165 having the capacity $C_1$.

Accordingly, the strip dual mode filter 221 functions in the same manner as the strip dual mode filter 161 shown in FIG. 16.

Next, a fifth embodiment of the third concept is described with reference to FIGS. 23, 24.

Figure 23A:
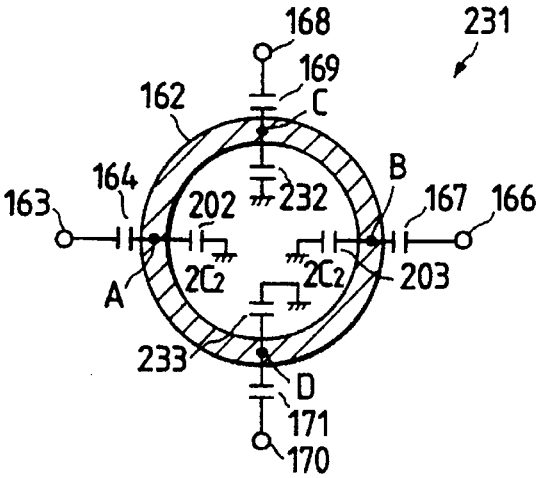
FIG. 23A is a plan view of a strip dual mode filter according to a fifth embodiment of the third concept.
Figure 24:
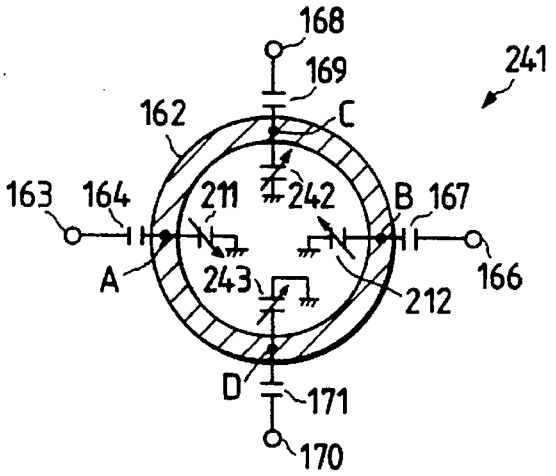
FIG. 24 is a plan view of a strip dual mode filter according to another modification of the fifth embodiment in the third concept.

FIG. 23A is a plan view of a strip dual mode filter according to a fifth embodiment of the third concept.

As shown in FIG. 23A, a strip dual mode filter 231 comprises the strip line ring resonator 162 for resonating the first microwaves and the third microwaves, the first input terminal 163, the first input coupling capacitor 164, the first inlet grounded capacitor 202, the first outlet grounded capacitor 203, the first output terminal 166, the first output coupling capacitor 167, the second input terminal 168 excited by the first microwaves, the second input coupling capacitor 169, a second inlet grounded capacitor 232 of which one end is connected to the coupling point C and another end is grounded, a second outlet grounded capacitor 233 of which one end is connected to the coupling point D and another end is grounded, the second output terminal 170, and the second output coupling capacitor 171.

Figure 23B:
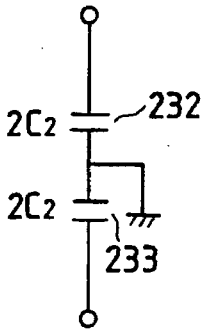
FIG. 23B shows a series of capacitors substantially agreeing with a pair of grounded capacitors shown in FIG. 23A.
Figure 23C:
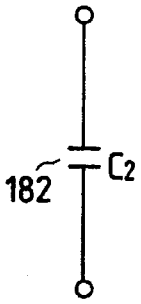
FIG. 23C shows an electric circuit equivalent to the capacitors shown in FIG. 23B.

The second inlet and outlet grounded capacitors 232, 233 respectively have a capacitance $2C_2$ which is twice as many as the capacitance $C_2$ of the second coupling capacitor 182. Also, as shown in FIG. 23B, the second inlet and outlet grounded capacitors 232, 233 are substantially connected in series. Therefore, an electric circuit formed of the second inlet and outlet grounded capacitors 232, 233 is equivalent to the capacitor 182 having the capacity $C_2$ as shown in FIG. 23C.

Accordingly, the strip dual mode filter 231 functions in the same manner as the strip dual mode filter 181 shown in FIG. 18.

In the fifth embodiment of the third concept, the capacitance $2C_2$ of each of the second inlet and outlet grounded capacitors 232, 233 are fixed. However, as a strip dual mode filter 241 is shown in FIG. 24, it is preferred that variable capacitors 242, 243 be utilized in place of the second inlet and outlet grounded capacitors 232, 233 and the variable capacitors 211, 212 be utilized in place of the first inlet and outlet grounded capacitors 202, 203. In this case, because capacitances of the variable capacitors 242, 243 are variable, the capacitances of the variable capacitors 242, 243 can be minutely adjusted after the filter 241 is manufactured, even though the capacitances of the variable capacitors 242, 243 are slightly out of designed values. Accordingly, a yield rate of the filter 241 can be increased as compared with the filter 231.

Next, a sixth embodiment of the third concept is described with reference to FIGS. 25A, 25B.

Figure 25A:
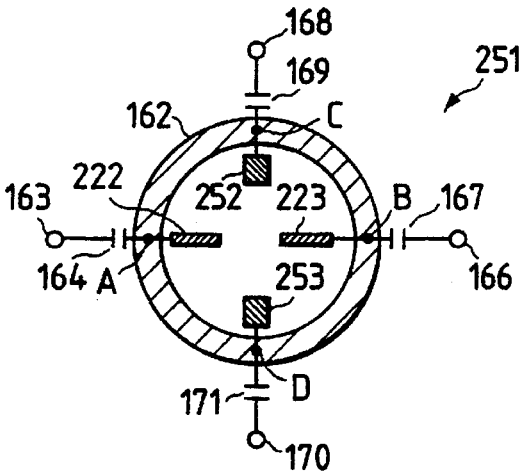
FIG. 25A is a plan view of a strip dual mode filter according to a sixth embodiment of the third concept.
Figure 25B:
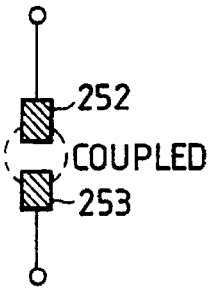
FIG. 25B shows a pair of strip lines coupled to each other, the strip lines being substantially equivalent to open end strip lines shown in FIG. 25A.

FIG. 25A is a plan view of a strip dual mode filter according to a sixth embodiment of the third concept.

As shown in FIG. 25A, a strip dual mode filter 251 comprises the strip line ring resonator 162 for resonating the first microwaves and the third microwaves, the first input terminal 163, the first input coupling capacitor 164, the first inlet open end strip line 222, the first outlet open end strip line 223 connected at the coupling point B, the first output terminal 166, the first output coupling capacitor 167, the second input terminal 168 excited by the third microwaves, the second input coupling capacitor 169, a second inlet open end strip line 252 connected at the coupling point C, a second outlet open end strip line 253 connected at the coupling point D, the second output terminal 170, and the second output coupling capacitor 171.

The second inlet and outlet open end strip lines 252, 253 respectively have a distributed capacitance $2C_2$ which is twice as many as the capacitance $C_2$ of the second coupling capacitor 182. Also, the second inlet and Outlet open end strip lines 252, 253 are substantially replaced with a pair of strip lines coupled to each other as shown in FIG. 25B. Therefore, an electric circuit formed of the second inlet and outlet open end strip lines 252, 253 is equivalent to the capacitor 182 having the capacity $C_2$.

Accordingly, the strip dual mode filter 251 functions in the same manner as the strip dual mode filter 181 shown in FIG. 18.

Next, a seventh embodiment of the third concept is described with reference to FIGS. 26A, 26B.

Figure 26A:
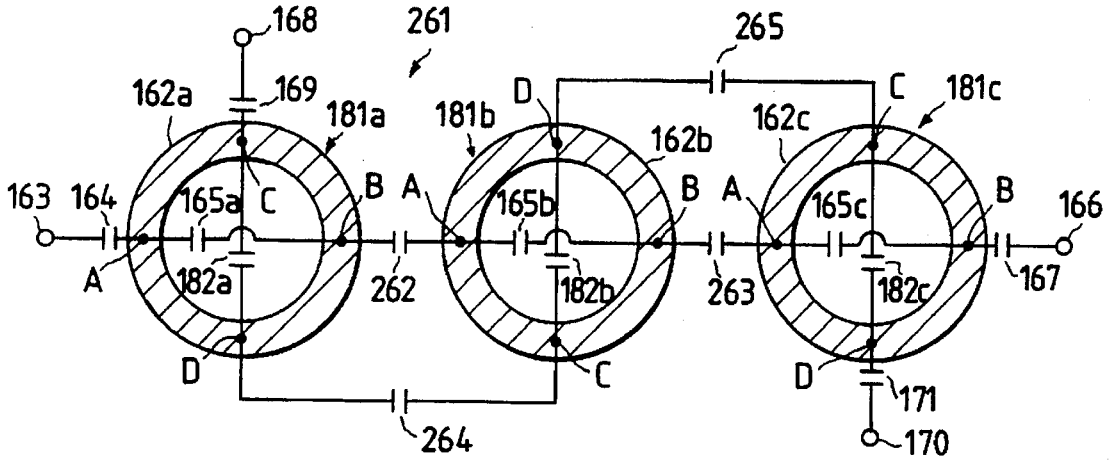
FIG. 26A is a plan view of a dual mode multistage filter formed of a series of three strip dual mode filters shown in FIG. 18 according to a seventh embodiment of the third concept.

FIG. 26A is a plan view of a multistage filter formed of a series of three strip dual mode filters shown in FIG. 18 according to a seventh embodiment of the third concept.

As shown in FIG. 26, a multistage filter 261 comprises the strip dual mode filter 181*a* in a first stage, the strip dual mode filter 181*b* in a second stage, the strip dual mode filter 181*c* in a third stage, a first inter-layer coupling capacitor 262 coupling the coupling point B of the strip dual mode filter 181*a* to the coupling point A of the strip dual mode filter 181*b*, a second inter-layer coupling capacitor 263 coupling the coupling point B of the strip dual mode filter 181*b* to the coupling point A of the strip dual mode filter 181*c*, a third inter-layer coupling capacitor 264 coupling the coupling point D of the strip dual mode filter 181*a* to the coupling point C of the strip dual mode filter 181*b*, and a fourth inter-layer coupling capacitor 263 coupling the coupling point D of the strip dual mode filter 181*b* to the coupling point C of the strip dual mode filter 181*c*.

In the above configuration, the first microwaves transferred from the input terminal 163 through the first input coupling capacitor 164 are resonated in the ring resonator 162*a* of the filter 181*a*, and the first microwaves are transferred to the ring resonator 162*b* of the filter 181*b* through the first inter-layer coupling capacitor 262. Thereafter, the first microwaves are resonated in the ring resonator 162*b* of the filter 181*b*, and the first microwaves are transferred to the ring resonator 162*c* of the filter 181*c* through the second inter-layer coupling capacitor 263. Thereafter, the first microwaves are resonated in the ring resonator 162*c* of the filter 181*c*, and the first microwaves are transferred to the first output terminal 166.

Also, the third microwaves transferred from the second input terminal 168 through the input coupling capacitor 169 are resonated in the ring resonator 162*a* of the filter 181*a*, and the third microwaves are transferred to the ring resonator 162*b* of the filter 181*b* through the third inter-layer coupling capacitor 264. Thereafter, the third microwaves are resonated in the ring resonator 162*b* of the filter 181*b*, and the third microwaves are transferred to the ring resonator 162*c* of the filter 181*c* through the fourth inter-layer coupling capacitor 265. Thereafter, the third microwaves are resonated in the ring resonator 162*c* of the filter 181*c*, and the third microwaves are transferred to the second output terminal 170.

Accordingly, the three-stage filter 261 can be manufactured by arranging three strip dual mode filters 181 in series, and two types of microwaves can be simultaneously resonated and filtered in the three-stage filter 261.

In the seventh embodiment of the third concept, the number of strip dual mode filters 182 is three. However, any number of strip dual mode filters 182 is available.

It is preferred that a series of strip dual mode filters selected from the group consisting of the strip dual mode filter 162, the strip dual mode filter 172, the strip dual mode filter 191, the strip dual mode filter 201, the strip dual mode filter 211, the strip dual mode filter 221, the strip dual mode filter 281, the strip dual mode filter 241, and the strip dual mode filter 251 be utilized in place of the strip dual mode filters 181.

Also, it is preferred that inductors respectively having a lumped or distributed inductance be utilized in place of the inter-stage coupling capacitors 262 to 265. Also, it is preferred that capacitors respectively having a distributed capacitance be utilized in place of the inter-stage coupling capacitors 262 to 265.

Figure 26B:
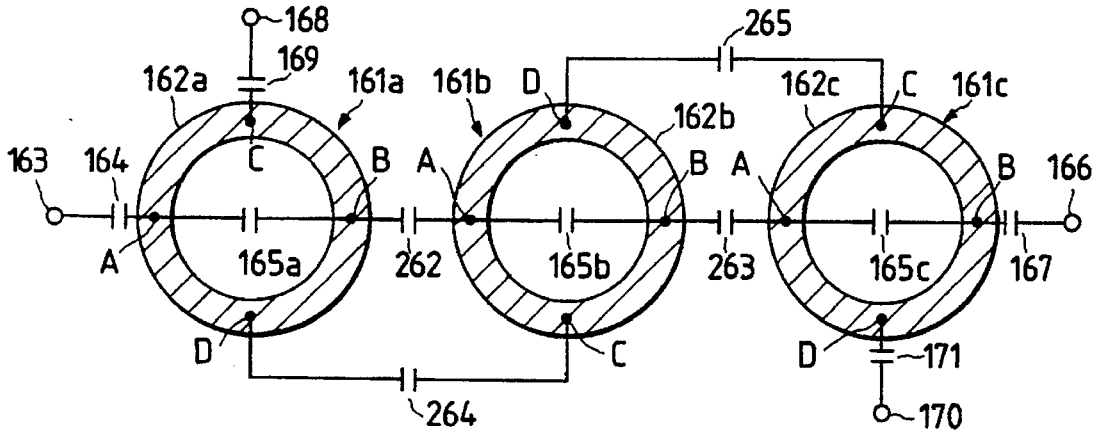
FIG. 26B is a plan view of a dual mode multistage filter formed of a series of three strip dual mode filters shown in FIG. 16 according to another modification of the seventh embodiment in the third concept.

Also, as shown in FIG. 26B, it is preferred that the strip dual mode filters 161 shown in FIG. 16 be utilized in place of the strip dual mode filters 181*a*, 182*b*, and 182*c*.

Figure 27:
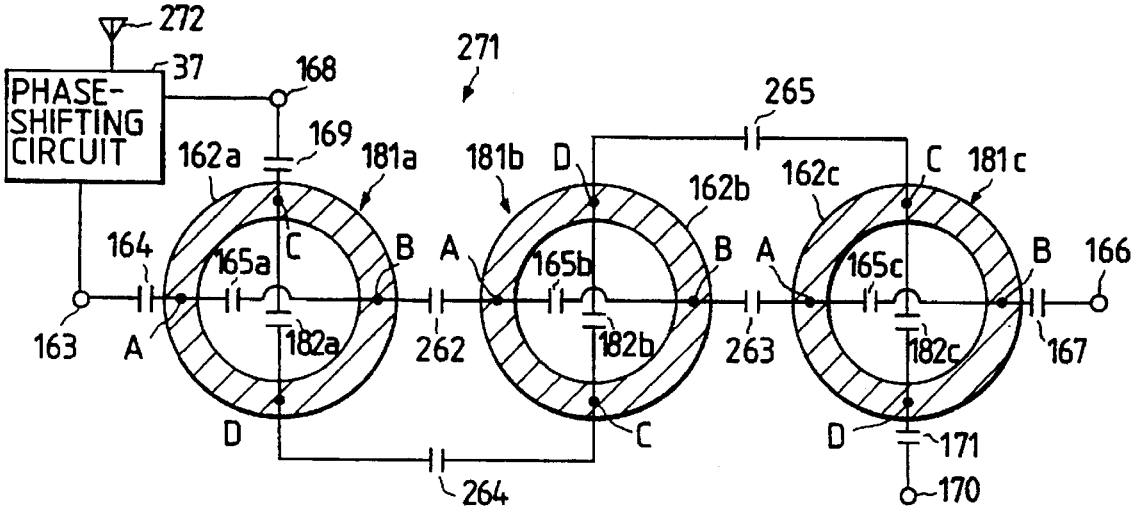
FIG. 27 is a plan view of a dual mode multistage filter in which an antenna and a phase-shifting circuit are added in the dual mode multistage filter shown in FIG. 26A.

Also, as a multistage filter 271 is shown in FIG. 27, it is preferred that the multistage filter 261 additionally comprise the phase-shifting circuit 37 shown in FIG. 3 coupled to the first and second input terminals 163, 168 and an antenna 272 for transceiving the first microwaves and the third microwaves.

In this case, the multistage filter 271 can function as a branching filter.

In the first to seventh embodiments of the third concept, the ring resonator 162 is in a single plate structure. However, it is preferred that the ring resonator 162 be formed in a multi-plate structure such as a tri-plate structure.

Also, the ring resonator 162 is formed of a balanced strip line shown in FIG. 4. However, it is preferred that the ring resonator 162 be formed of a microstrip.

Next, a first embodiment of a fourth concept is described with reference to FIG. 28.

Figure 28:
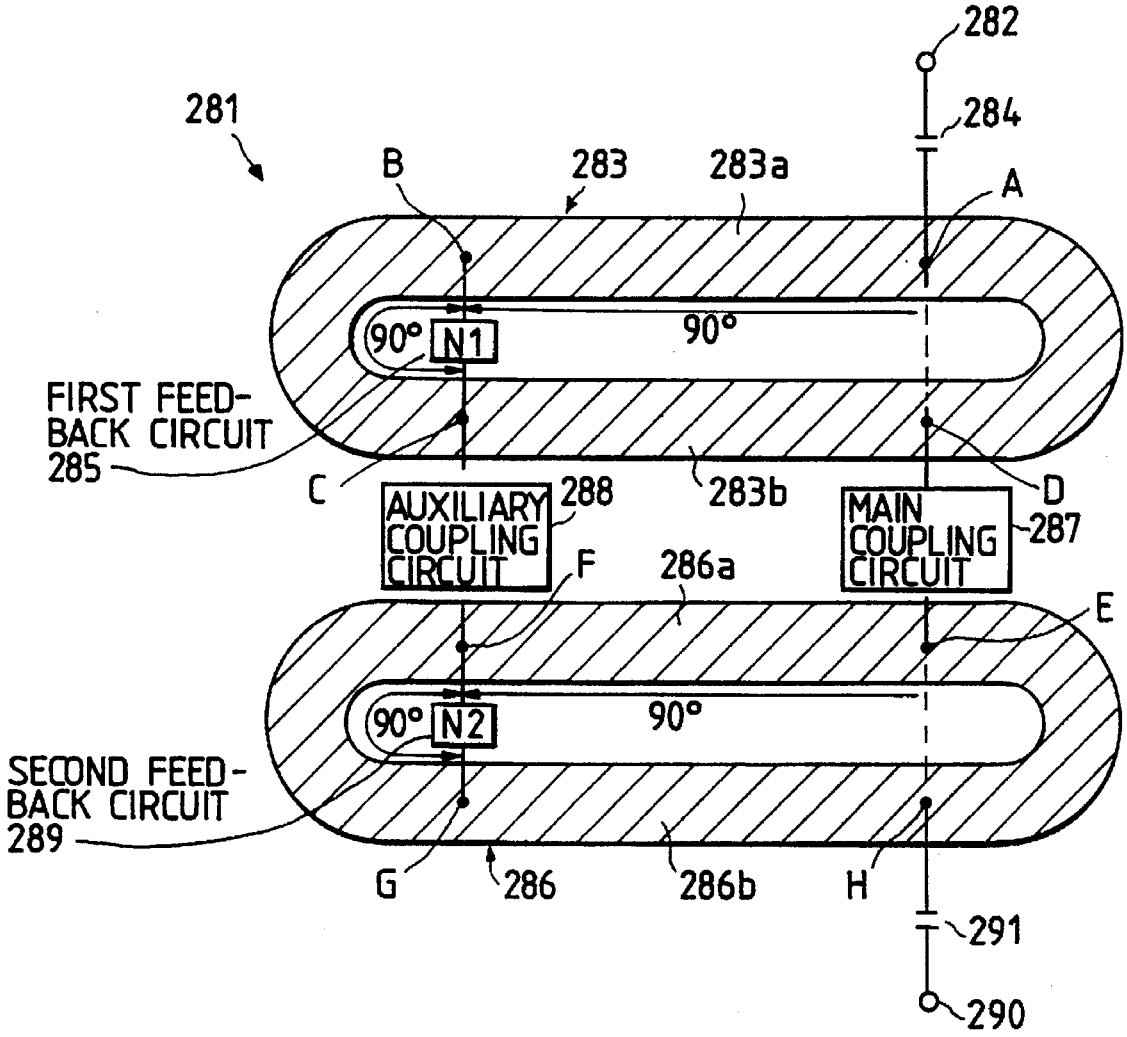
FIG. 28 is a plan view of a dual mode multistage filter according to a first embodiment of a fourth concept.

FIG. 28 is a plan view of a dual mode multistage filter according to a first embodiment of a fourth concept.

As shown in FIG. 28, a dual mode multistage filter 281 according to the first embodiment of the fourth concept comprises an input terminal 282 excited by microwaves having various wavelengths around a resonance wavelength $\lambda_o$, a closed loop-shaped first-stage strip resonator 283 in which the microwaves transferred from the input strip terminal 282 are resonated, an input coupling capacitor 284 connecting the input terminal 282 and a coupling point A of the first-stage strip resonator 283 to couple the input terminal 282 to the first-stage strip resonator 283, a first feed-back circuit 285 connecting coupling points B, C of the first-stage strip resonator 283, a closed loop-shaped second-stage strip resonator 286 in which the microwaves resonated in the first-stage strip resonator 283 are again resonated, a main coupling circuit 287 connecting a coupling point D of the first-stage strip resonator 283 and a coupling point E of the second-stage strip resonator 286, an auxiliary coupling circuit 288 connecting the coupling point C of the first-stage strip resonator 283 and a coupling point F of the second-stage strip resonator 286, a second feed-back circuit 289 connecting the coupling point F and a coupling point G of the second-stage strip resonator 286, an output strip terminal 290 which is excited by the microwaves resonated in the second-stage strip resonator 286, and an output coupling capacitor 291 connecting the output terminal 290 and a coupling point H of the second-stage strip resonator 286 to couple the output terminal 290 to the second-stage strip resonator 286.

The first-stage strip resonator 283 is the same dimensions as the second-stage strip resonator 286. In detail, the strip resonators 283, 286 respectively have an electric length equivalent to the resonance wavelength $\lambda_o$ and have a uniform line impedance. Also, the first-stage strip resonator 283 has a pair of straight strip lines 283*a*, 283*b* arranged in series, and the straight strip lines 283*a*, 283*b* are coupled to each other in electromagnetic coupling. In the same manner, the second-stage strip resonator 286 has a pair of straight strip lines 286*a*, 286*b* arranged in series, and the straight strip lines 286*a*, 286*b* are coupled to each other in electromagnetic coupling.

The coupling points A, B of the first-stage strip resonator 283 are positioned in the straight strip line 283*a* and the coupling point B is spaced 90 degrees in the electric length apart from the coupling point A. Also, the coupling points C, D of the first-stage strip resonator 283 are positioned in the straight strip line 283*b* and the coupling point C is spaced 180 degrees in the electric length apart from the coupling point A. The coupling point D is spaced 180 degrees in the electric length apart from the coupling point B.

In the same manner, the coupling points E, F of the second-stage strip resonator 286 are positioned in the straight strip line 286*a* and the coupling point F is spaced 90 degrees in the electric length apart from the coupling point E. Also, the coupling points G, H of the strip resonator 286 are positioned in the straight strip line 286*b* and the coupling point G is spaced 180 degrees in the electric length apart from the coupling point E. The coupling point H is spaced 180 degrees in the electric length apart from the coupling point F.

In the above configuration, microwaves having various wavelengths around the resonance wavelength $\lambda_o$ are transferred from the input terminal 282 to the coupling point A of the first-stage strip resonator 283. Therefore, the intensity of the electric field induced by the microwaves is increased to a maximum value at the coupling point A. Thereafter, the microwaves are circulated in the first-stage strip resonator 283 according to a characteristic impedance of the first-stage strip resonator 283. The characteristic impedance of the first-stage strip resonator 283 depends on the uniform line impedance of the first-stage strip resonator 283, the electromagnetic coupling between the straight strip lines 283*a*, 283*b*, and an impedance constant of the first feed-back circuit 285. Therefore, a major part of the microwaves are reflected by the straight strip lines 283*a*, 283*b* or pass through the first feed-back circuit 285 before the major part of the microwaves having the resonance wavelength $\lambda_o$ are resonated at the resonance wavelength $\lambda_o$ according to a first resonance mode to produce quarter-shift microwaves.

In contrast, a remaining part of the microwaves are resonated according to a second resonance mode without being reflected by the straight strip lines 283*a*, 283*b* nor passing through the first feed-back circuit 285 to produce non-shift microwaves.

As a result, the intensity of the electric field induced by the quarter-shift microwaves is increased to the maximum value at the coupling points B, D. In contrast, the intensity of the electric field induced by the non-shift microwaves is increased to the maximum value at the coupling point C because the coupling point C is spaced 180 degrees in the electric length apart from the coupling point A. Therefore, the phase of the quarter-shift microwaves shifts by 90 degrees as compared with the phase of the non-shift microwaves. The energy power of the quarter-shift microwaves is considerably larger than that of the non-shift microwaves at the resonance wavelength $\lambda_o$, and the energy power of the quarter-shift microwaves is almost the same level as that of the non-shift microwaves around the resonance wavelength $\lambda_o$.

Thereafter, the quarter-shift microwaves are transferred to the second-stage strip resonator 286 through the main coupling circuit 287, and the non-shift microwaves are transferred to the second-stage strip resonator 286 through the auxiliary coupling circuit 287.

In the second-stage strip resonator 286, the quarter-shift microwaves and the non-shift microwaves are circulated according to a characteristic impedance of the second-stage strip resonator 286. The characteristic impedance of the second-stage strip resonator 286 depends on the uniform line impedance of the second-stage strip resonator 286, the electromagnetic coupling between the straight strip lines 286*a*, 286*b*, and a second impedance constant of the second feed-back circuit 289. Therefore, the quarter-shift microwaves are reflected by the straight strip lines 286*a*, 286*b* or pass through the second feed-back circuit 289 before the quarter-shift microwaves are resonated according to a third resonance mode to produce half-shift microwaves. In this case, the intensity of the electric field induced by the half-shift microwaves is increased to the maximum value at the coupling points F, H. Thereafter, the half-shift microwaves are transferred from the coupling point H to the output terminal 290 through the output coupling capacitor 291.

In contrast, the non-shift microwaves are resonated according to a fourth resonance mode without being reflected by the straight strip lines 286*a*, 286*b* nor passing through the second feed-back circuit 289. In this case, the intensity of the electric field induced by the non-shift microwaves is increased to the maximum value at the coupling point H because the coupling point H is spaced 180 degrees in the electric length apart from the coupling point F. Thereafter, the non-shift microwaves are also transferred from the coupling point H to the output terminal 290 through the output coupling capacitor 291.

Figure 2A:
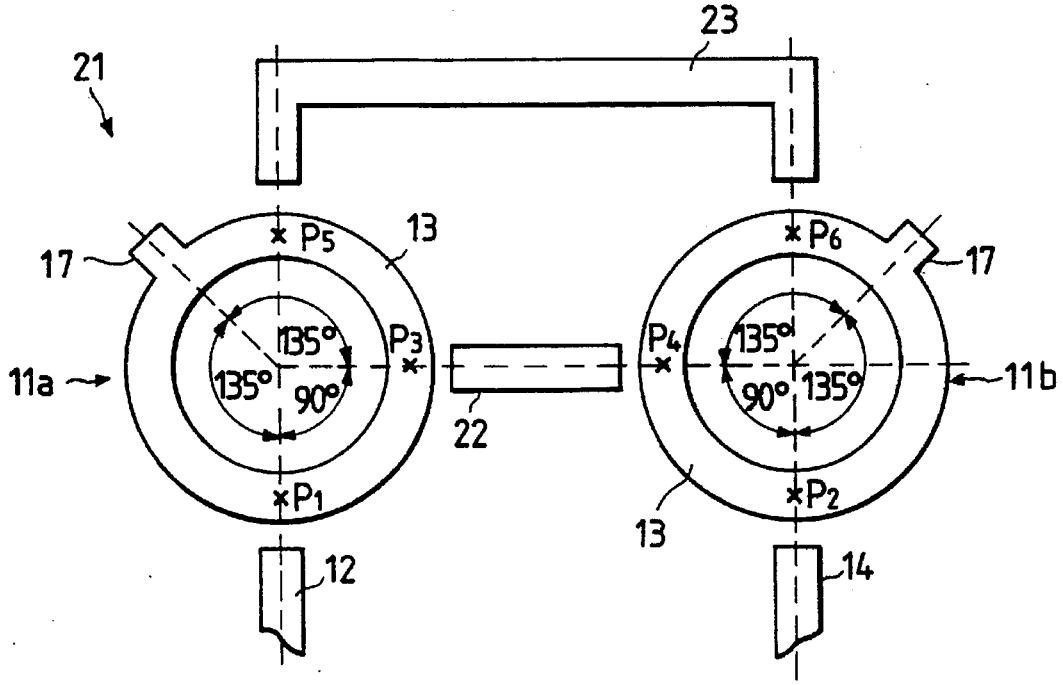
FIG. 2A PRIOR ART
FIG. 2A is a plan view of a conventional multistage filter in which two strip dual mode filters shown in FIG. 1 are arranged in series.
Figure 2B:
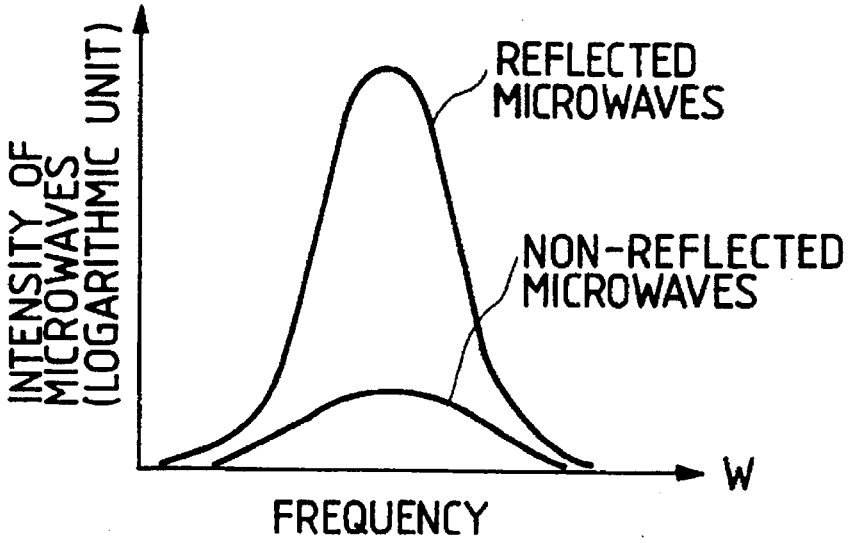
FIG. 2B PRIOR ART
FIG. 2B graphically shows frequency characteristics of reflected microwaves and non-reflected microwaves obtained in the conventional multistage filter shown in FIG. 2A.
Figure 2C:
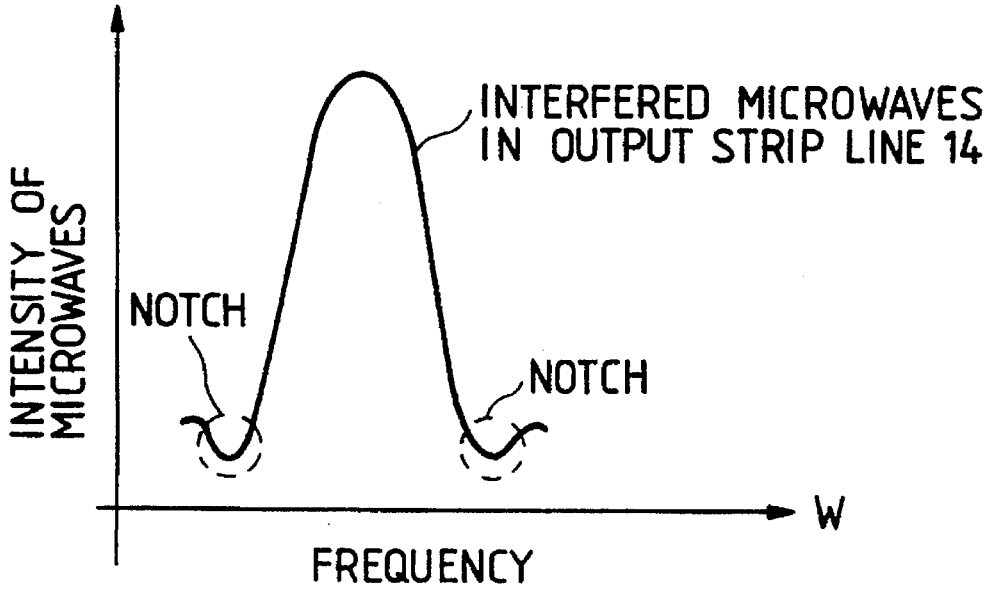
FIG. 2C PRIOR ART
FIG. 2C graphically shows frequency characteristics of interfered microwaves obtained in the conventional multistage filter shown in FIG. 2A.

The phase of the half-shift microwaves additionally shifts by 90 degrees. Therefore, the phase of the half-shift microwaves totally shifts by 180 degrees as compared with the phase of the non-shift microwaves. That is, the half-shift microwaves and the non-shift microwaves are electromagnetically interfered with each other in the output terminal 290 to reduce the intensity of the half-shift microwaves. As a result, interfered microwaves are formed of the half-shift microwaves and the non-shift microwaves, and a pair of notches (or a pair of poles) are generated at both sides of a resonance frequency $\omega_o$ relating to the resonance wavelength $\lambda_o$ in frequency characteristics of the interfered microwaves, in the same manner as the multistage filter 21 shown in FIG. 2A.

Accordingly, the dual mode multistage filter 281 can function as an elliptic filter in which the notches are generated to obtain a steep frequency characteristic.

Also, the intensity of the interfered microwaves can be adjusted by changing the intensity of the half-shift microwaves. The intensity of the half-shift microwaves are adjusted with the electromagnetic coupling between the straight strip lines 283*a*, 283*b*, the electromagnetic coupling between the straight strip lines 286*a*, 286*b*, the feed-back circuits 285, 289, and the main coupling circuit 287.

Also, the depth of the notches positioned at both sides of the resonance frequency $\omega_o$ in the frequency characteristics of the interfered microwaves can be adjusted by changing the intensity of the non-shift microwaves. The intensity of the non-shift microwaves are adjusted with the auxiliary coupling circuit 288.

Accordingly, the microwaves can, be suitably resonated and filtered according to designed frequency characteristics.

Next, first to third modifications of the first embodiment in the fourth concept is described with reference to FIGS. 29 to 31.

Figure 29:
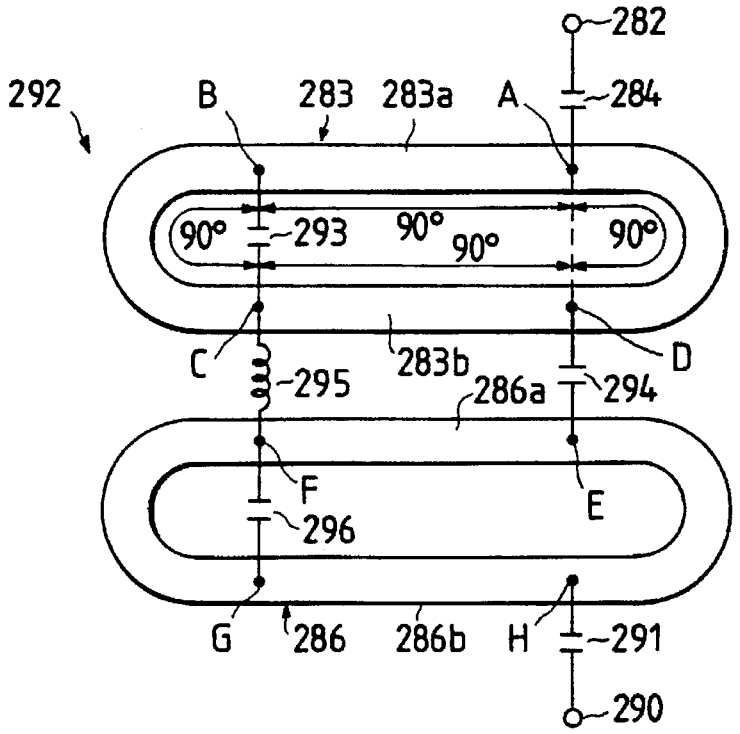
FIG. 29 is a plan view of a dual mode multistage filter according to a first modification of the first embodiment in the fourth concept.

FIG. 29 is a plan view of a dual mode multistage filter according to a first modification of the first embodiment in the fourth concept.

As shown in FIG. 29, a dual mode multistage filter 292 according to the first modification comprises a first feedback capacitor 293 in place of the first feed-back circuit 285, a main coupling capacitor 294 in place of the main coupling circuit 287, an auxiliary coupling inductor 295 in place of the auxiliary coupling circuit 288, and a second feed-back capacitor 296 in place of the second feed-back circuit 289.

In the above configuration, microwaves are resonated and filtered in dual modes. For example, a relative dielectric constant $\epsilon_r$ of a dielectric substrate composing the strip resonators 283, 286 is set to 10.2, a height of the dielectric substrate is set to 0.635 mm, line impedances of the strip resonators 283, 286 are respectively set to 35 Ω, capacitances of the input and output coupling capacitors 284, 291 are respectively set to 0.78 pF, capacitances of the first and second feed-back capacitors 293, 296 are respectively set to 0.36 pF, a capacitance of the main coupling capacitor 294 is set to 33 pF, and an inductance of the auxiliary coupling inductor 295 is set to 73 nH.

Figure 30:
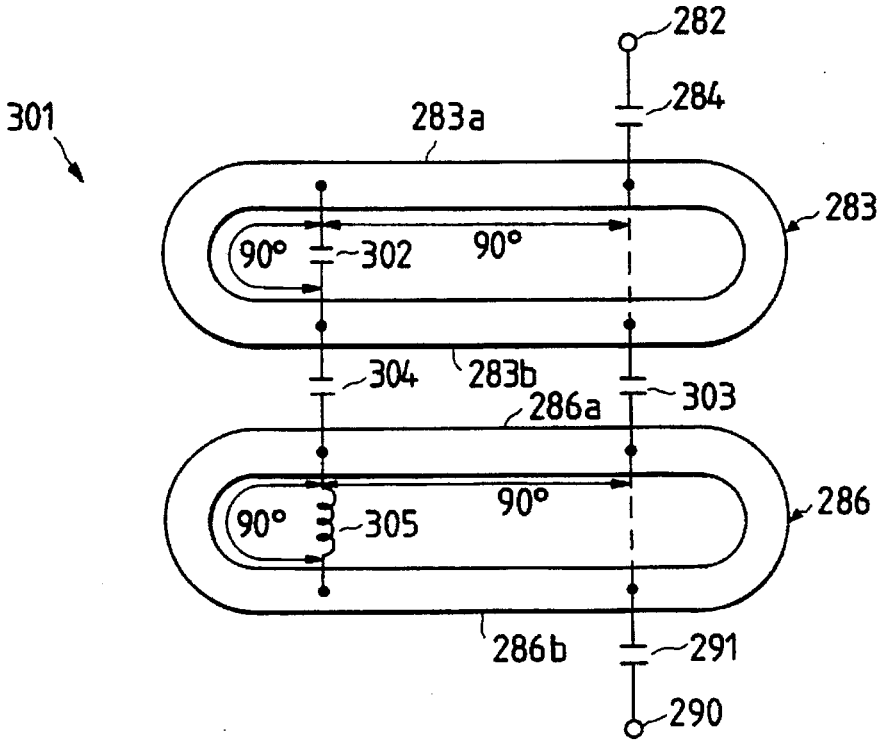
FIG. 30 is a plan view of a dual mode multistage filter according to a second modification of the first embodiment in the fourth concept.

FIG. 30 is a plan view of a dual mode multistage filter according to a second modification of the first embodiment in the fourth concept.

As shown in FIG. 30, a dual mode multistage filter 301 according to the second modification comprises a first feedback capacitor 302 in place of the first feed-back circuit 285, a main coupling capacitor 303 in place of the main coupling circuit 287, an auxiliary coupling capacitor 304 in place of the auxiliary coupling circuit 288, and a second feed-back inductor 305 in place of the second feed-back circuit 289.

In the above configuration, microwaves are resonated and filtered in dual modes. For example, a relative dielectric constant $\epsilon_r$ of a dielectric substrate composing the strip resonators 283, 286 is set to 10.2, a height of the dielectric substrate is set to 0.635 mm, line impedances of the strip resonators 283, 286 are respectively set to 35 Ω, capacitances of the input and output coupling capacitors 284, 301 are respectively set to 0.55 pF, a capacitance of the first feed-back capacitor 302 is set to 6.7 pF, a capacitance of the main coupling capacitor 303 is set to 0.41 pF, a capacitance of the auxiliary coupling capacitor 304 is set to 0.01 pF, and an inductor of the second feed-back inductance 305 is set to 18 nH.

Figure 31:
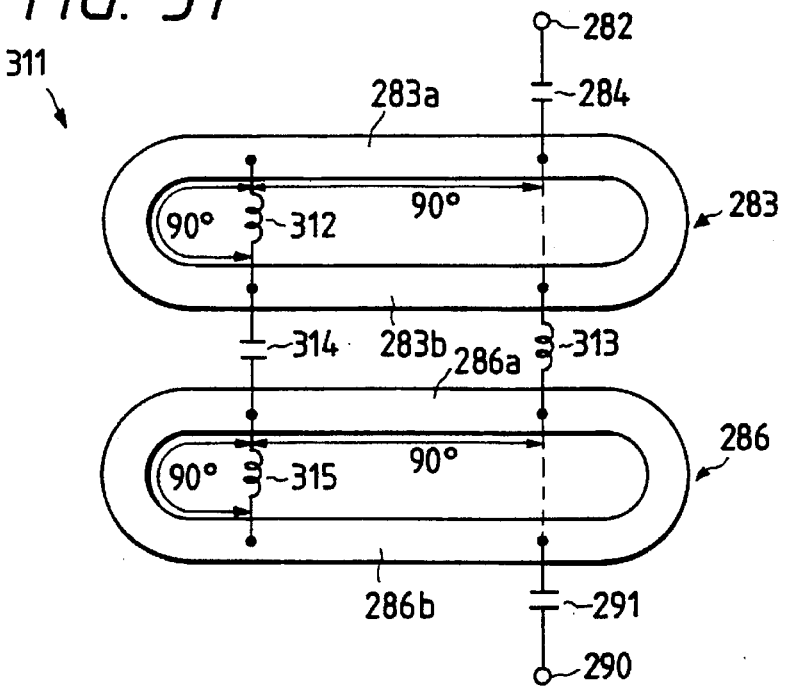
FIG. 31 is a plan view of a dual mode multistage filter according to a third modification of the first embodiment in the fourth concept.

FIG. 31 is a plan view of a dual mode multistage filter according to a third modification of the first embodiment in the fourth concept.

As shown in FIG. 31, a dual mode multistage filter 311 according to the third modification comprises a first feed-back inductor 312 in place of the first feed-back circuit 285, a main coupling inductor 313 in place of the main coupling circuit 287, an auxiliary coupling capacitor 314 in place of the auxiliary coupling circuit 288, and a second feed-back inductor 315 in place of the second feed-back circuit 289.

In the above configuration, microwaves are resonated and filtered in dual modes. For example, a relative dielectric constant $\epsilon_r$ of a dielectric substrate composing the strip resonators 283, 286 is set to 10.2, a height of the dielectric substrate is set to 0.635 mm, line impedances of the strip resonators 283, 286 are respectively set to 35 Ω, capacitances of the input and output coupling capacitors 284, 311 are respectively set to 3.0 pF, inductances of the first and second feed-back inductors 312, 315 are respectively set to 6.0 nH, an inductance of the main coupling inductor 313 is set to 28 nH, and a capacitance of the auxiliary coupling capacitor 314 is set to 0.01 pF.

Next, a second embodiment of the fourth concept is described with reference to drawings.

Figure 32:
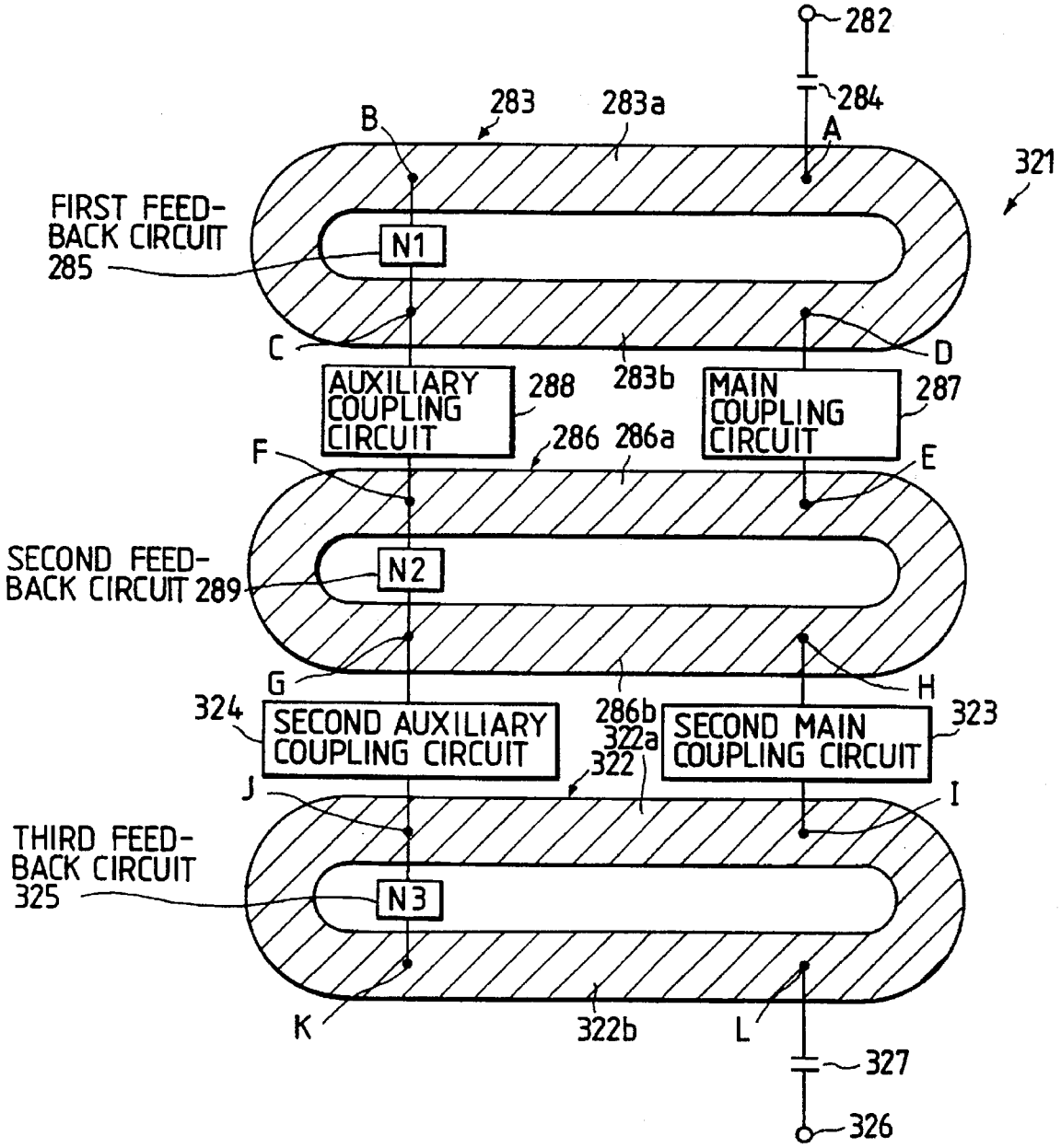
FIG. 32 is a plan view of a dual mode multistage filter according to a second embodiment of the fourth concept.

FIG. 32 is a plan view of a dual mode multistage filter according to a second embodiment of the fourth concept.

As shown in FIG. 32, a dual mode multistage filter 321 according to the second embodiment of the fourth concept comprises the input terminal 282, the first-stage strip resonator 283, the input coupling capacitor 284, the first feed-back circuit 285, the second-stage strip resonator 286, the main coupling circuit 287, the auxiliary coupling circuit 288, the second feed-back circuit 289, a closed loop-shaped third-stage strip resonator 322 for resonating the microwaves resonated in the second-stage strip resonator 286, a second main coupling circuit 323 connecting the coupling point H of the second-stage strip resonator 286 and a coupling point I of the third-stage strip resonator 322, a second auxiliary coupling circuit 324 connecting the coupling point G of the second-stage strip resonator 286 and a coupling point J of the third-stage strip resonator 322, a third feed-back circuit 325 connecting the coupling point J and a coupling point K of the third-stage strip resonator 322, an output strip terminal 326 which is excited by the microwaves resonated in the third-stage strip resonator 322, and an output coupling capacitor 327 connecting the output terminal 326 and a coupling point L of the third-stage strip resonator 322 to couple the output terminal 326 to the third-stage strip resonator 322.

The third-stage strip resonator 322 is the same dimensions as the strip resonators 283, 286. That is, the third-stage strip resonator 322 has an electric length equivalent to the resonance wavelength $\lambda_o$ and have a uniform line impedance. Also, the third-stage strip resonator 322 has a pair of straight strip lines 322*a*, 322*b* arranged in series, and the straight strip lines 322*a*, 322*b* are coupled to each other in electromagnetic coupling.

The coupling points I, J of the third-stage strip resonator 322 are positioned in the straight strip line 322*a*, and the coupling point I is spaced 90 degrees in the electric length apart from the coupling point J. Also, the coupling points K, L of the third-stage strip resonator 322 are positioned in the straight strip line 322*b* and the coupling point K is spaced 180 degrees in the electric length apart from the coupling point I. The coupling point L is spaced 180 degrees in the electric length apart from the coupling point J.

In the above configuration, first quarter-shift microwaves are resonated according to the first resonance mode in the first-stage strip resonator 283 and are again resonated according to the third resonance mode in the second-stage strip resonator 286 to produce first half-shift microwaves, in the same manner as in the multistage dual mode filter 281. The first half-shift microwaves are transferred from the coupling point H to the second main coupling circuit 323. Also, the non-shift microwaves are resonated according to the second resonance mode in the first-stage strip resonator 283 and are again resonated according to the fourth resonance mode in the second-stage strip resonator 286, in the same manner as in the multistage dual mode filter 281. The non-shift microwaves are transferred from the coupling point H to the second main coupling circuit 323.

Therefore, the first half-shift microwaves and the non-shift microwaves are electromagnetically interfered with each other in the second main coupling circuit 323 to produce second-half microwaves in which the notches are arranged at the both sides of the resonance frequency $\omega_o$ in the frequency characteristics of the second-half microwaves. Thereafter, the second-half microwaves are transferred to the coupling point I of the third-stage strip resonator 322.

Also, the first quarter-shift microwaves resonated in the first-stage strip resonator 283 are again resonated to produce second quarter-wave microwaves according to a fifth resonance mode without being reflected by the straight strip lines 286*a*, 286*b* nor passing through the second feed-back circuit 289. Therefore, the intensity of the electric field induced by the second quarter-shift microwaves according to the fifth resonance mode is increased to the maximum value at the coupling point G. In addition, the non-shift microwaves resonated in the first-stage strip resonator 283 are reflected by the straight strip lines 286*a*, 286*b* or pass through the second feed-back circuit 289. Thereafter, the non-shift microwaves are again resonated according to the fifth resonance mode to combine with the second-quarter microwaves. The second-quarter microwaves are transferred to the coupling point J of the third-stage strip resonator 322 through the second auxiliary coupling circuit 324.

Thereafter, the second half-shift microwaves are reflected by the straight strip lines 322*a*, 322*b* or pass through the third feed-back circuit 325, so that the phase of the second half-shift microwaves additionally shifts by 90 degrees. Thereafter, the second half-shift microwaves are again resonated according to a sixth resonance mode to produce ¾-shift microwaves. As a result, the intensity of the electric field induced by the ¾-shift microwaves is increased to the maximum value at the coupling point H, and the ¾-shift microwaves are transferred to the output terminal 326 through the output coupling capacitor 327.

In contrast, the second quarter-shift microwaves are again resonated according to a seventh resonance mode without being reflected by the straight strip lines 322*a*, 322*b* nor passing through the third feed-back circuit 325. Therefore, the intensity of the electric field induced by the second quarter-shift microwaves is increased to the maximum value at the coupling point H, and the second quarter-shift microwaves are transferred to the output terminal 328 through the output coupling capacitor 327. In this case, the phase of the ¾-shift microwaves according to the sixth resonance mode shifts by 180 degrees as compared with the phase of the second quarter-shift microwaves according to the seventh resonance mode. Therefore, the ¾-shift microwaves and the second quarter-shift microwaves are electromagnetically interfered with each other at the output terminal 326 to reduce the intensity of the ¾-shift microwaves. As a result, the notches positioned at both sides of the resonance frequency $\omega_o$ in the frequency characteristics of the ¾-shift microwaves are furthermore deepened.

Accordingly, the microwaves can be steeply filtered in the dual mode multistage filter 321 as compared with in the dual mode multistage filter 281.

Next, a first modification of the second embodiment in the fourth concept is described with reference to drawings.

Figure 33:
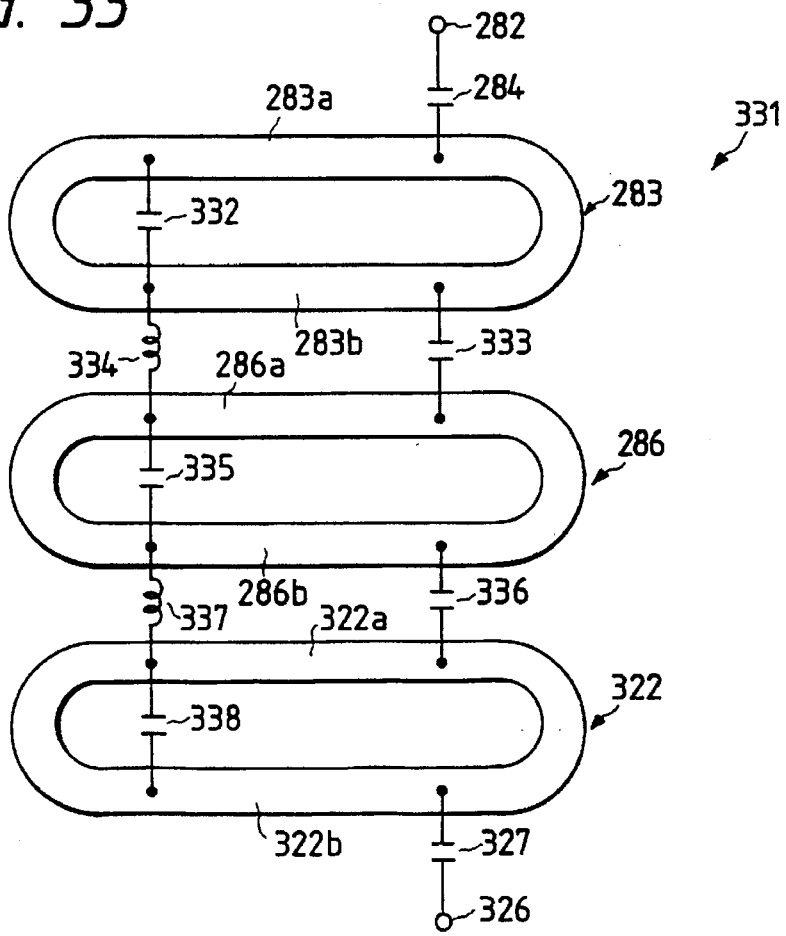
FIG. 33 is a plan view of a dual mode multistage filter according to a first modification of the second embodiment in the fourth concept.

FIG. 33 is a plan view of a dual mode multistage filter according to a first modification of the second embodiment in the fourth concept.

As shown in FIG. 33, a dual mode multistage filter 331 according to the first modification comprises a first feedback capacitor 332 in place of the first feed-back circuit 285, a main coupling capacitor 333 in place of the main coupling circuit 287, an auxiliary coupling inductor 334 in place of the auxiliary coupling circuit 288, a second feedback capacitor 335 in place of the second feed-back circuit 289, a second main coupling capacitor 336 in place of the second main coupling circuit 323, a second auxiliary coupling inductor 337 in place of the second auxiliary coupling circuit 325, and a third feed-back capacitor 338 in place of the third feed-back circuit 325.

In the above configuration, microwaves are resonated and filtered in dual modes. For example, a relative dielectric constant $\epsilon_r$ of a dielectric substrate composing the strip resonators 283, 286, and 322 is set to 10.2, a height of the dielectric substrate is set to 0.635 mm, line impedances of the strip resonators 283, 286, and 322 are respectively set to 30 Ω, capacitances of the input and output coupling capacitors 284, 327 are respectively set to 1.97 pF, capacitances of the first and third feed-back capacitors 332, 338 are respectively set to 0.3 pF, capacitances of the main coupling capacitors 333, 336 are respectively set to 0.14 pF, inductances of the auxiliary coupling inductors 334, 337 are respectively set to 15.5 nH, and a capacitance of the second feed-back capacitor 335 is set to 0.137 pF.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. A strip dual mode filter in which a microwave is resonated and filtered, comprising:

a closed loop-shaped strip line for resonating and filtering the microwave according to a characteristic impedance of the closed loop-shaped strip line, the closed loop-shaped strip line having an electric length equivalent to a wavelength of the microwave and having a uniform line impedance;

input coupling means for transferring the microwave to a first coupling point of the closed loop-shaped strip line in electromagnetic coupling;

a secondary microwave transmitting line for transmitting the microwave resonated and filtered in the closed loop-shaped strip line to change the characteristic impedance of the closed loop-shaped strip line, the secondary microwave transmitting line being coupled to second and third coupling points of the closed loop-shaped strip line in electromagnetic coupling, the second coupling point being spaced a half-wave length of the microwave apart from the first coupling point, and the third coupling portion being spaced a quarter-wave length of the microwave apart from the first coupling point; and output coupling means for outputting the microwave which is resonated and filtered in the closed loop-shaped strip line according to the characteristic impedance of the closed loop-shaped strip line changed by the secondary microwave transmitting line, the microwave being output from a fourth coupling point spaced a half-wave length of the microwave apart from the third coupling point in electromagnetic coupling, wherein the secondary microwave transmitting line comprises a feed-back circuit in which a phase of the microwave transferred from the second coupling point of the closed loop-shaped strip line shifts by a multiple of a half-wave length of the microwave to produce a feed-back microwave which is transferred to the third coupling point of the closed loop-shaped strip line, the input coupling means comprises a microwave receiver and an input coupling inductor for coupling the microwave receiver to the closed loop-shaped strip line in inductive coupling, and the output coupling means comprises a microwave transfer and an output coupling inductor for coupling the microwave transfer to the closed loop-shaped strip line in inductive coupling.

2. A filter according to claim 1 in which the input coupling inductor and the output coupling inductor are respectively formed of an inductor having a lumped inductance.

3. A filter according to claim 1 in which the input coupling inductor and the output coupling inductor are respectively formed of a narrow strip line having a distributed inductance.

4. A filter according to claim 1 in which the phase-shifting circuit comprises a strip line through which the microwave transmits.

5. A filter according to claim 1 in which the phase-shifting circuit comprises a lumped impedance element such as a capacitor or an inductor.

6. A filter according to claim 1 in which the phase-shifting circuit comprises a combination circuit of an amplifier and a strip line in which the phase of the microwave is corrected.

* * * * *